US007754662B2

(12) United States Patent
Aswath et al.

(10) Patent No.: US 7,754,662 B2
(45) Date of Patent: Jul. 13, 2010

(54) HIGH PERFORMANCE LUBRICANTS AND LUBRICANT ADDITIVES FOR CRANKCASE OILS, GREASES, GEAR OILS AND TRANSMISSION OILS

(76) Inventors: Pranesh B. Aswath, 2674 Juniper La., Grapevine, TX (US) 76051; Harold Shaub, 609 Beacon Hill Dr., Coppell, TX (US) 75019; Ramoun Mourhatch, 2813 W. Royal La., #2507, Irving, TX (US) 75063; Krupal Patel, 301 W. Hawkins Pkwy., #604, Longview, TX (US) 75605; David P. Owen, 4136 Hollow Oak, Dallas, TX (US) 75287; Ronald L. Eisenbaumer, 2325 Stone Bridge Dr., Arlington, TX (US) 76006

( * ) Notice: Subject to any disclaimer, the term of this patent is extended or adjusted under 35 U.S.C. 154(b) by 0 days.

(21) Appl. No.: 11/870,993

(22) Filed: Oct. 11, 2007

(65) Prior Publication Data

US 2009/0036336 A1 Feb. 5, 2009

Related U.S. Application Data

(63) Continuation-in-part of application No. 11/259,635, filed on Oct. 26, 2005.

(51) Int. Cl.

| | |
|---|---|
| ***C10M 177/00*** | (2006.01) |
| ***C10M 135/18*** | (2006.01) |
| ***C10M 169/04*** | (2006.01) |
| ***B01F 17/00*** | (2006.01) |
| ***C07F 15/04*** | (2006.01) |
| ***C07F 9/02*** | (2006.01) |

(52) U.S. Cl. ..... 508/181; 508/363; 508/433; 508/165; 556/13; 556/24

(58) Field of Classification Search ..... 508/181, 508/363, 368, 369, 371, 433, 165, 171, 172; 556/13, 14, 24, 25

See application file for complete search history.

(56) References Cited

U.S. PATENT DOCUMENTS 2,884,431 A 4/1959 Smith et al.

(Continued)

FOREIGN PATENT DOCUMENTS

EP 856570 A2 * 8/1998

(Continued)

OTHER PUBLICATIONS

International Search Report and Written Opinion Issued for PCT/US2006/40823 dated Apr. 24, 2007.

*Primary Examiner*—Glenn A Caldarola
*Assistant Examiner*—Vishal Vasisth
(74) *Attorney, Agent, or Firm*—Parks IP Law LLC

(57) ABSTRACT

A lubricant additive produced by various processes, including mixing an organophosphate and an organofluorine compound, reacting an organophosphate and an organofluorine compound, reacting a fluorinated organophosphate and an organofluorine compound (with or without molybendum disulfide), or reacting an organophosphate, a metal halide and an organofluorine compound (with or without molybendum disulfide), to produce a reaction mixture comprising the lubricant additive. Also, a lubricant produced by various processes, including mixing an organophosphate and an organofluorine compound, reacting an organophosphate and an organofluorine compound, reacting a fluorinated organophosphate and an organofluorine compound (with or without molybendum disulfide), or reacting an organophosphate, a metal halide and an organofluorine compound (with or without molybendum disulfide), and adding at least a portion of the reaction mixture to a lubricant base.

25 Claims, 23 Drawing Sheets

FI-PTFE with Carboxylic Functionality + ZDDP

U.S. PATENT DOCUMENTS

| | | | | |
|---|---|---|---|---|
| 2,959,544 | A | 11/1960 | Smith et al. | |
| 4,130,492 | A | 12/1978 | Longo et al. | |
| 4,313,761 | A * | 2/1982 | Joyce et al. | 106/18.19 |
| 4,832,859 | A | 5/1989 | Basset et al. | |
| 5,133,886 | A | 7/1992 | Hata | |
| 5,385,683 | A | 1/1995 | Ransom | |
| 5,595,962 | A | 1/1997 | Caporiccio et al. | |
| 5,641,731 | A | 6/1997 | Baumgart et al. | |
| 5,767,045 | A | 6/1998 | Ryan | |
| 5,877,128 | A | 3/1999 | Greer | |
| 6,258,758 | B1 * | 7/2001 | Greer | 508/113 |
| 6,413,918 | B1 | 7/2002 | Beatty et al. | |
| 6,541,430 | B1 | 4/2003 | Beatty | |
| 6,642,186 | B2 | 11/2003 | Beatty et al. | |
| 6,732,320 | B1 | 5/2004 | Beatty et al. | |
| 6,764,984 | B2 | 7/2004 | Beatty | |
| 2003/0139300 | A1 | 7/2003 | Beatty | |
| 2005/0119135 | A1 * | 6/2005 | Shaub et al. | 508/165 |

FOREIGN PATENT DOCUMENTS

| | | |
|---|---|---|
| GB | 804777 | 11/1958 |
| WO | WO-2005/037965 | 4/2005 |

* cited by examiner

*FIG. 1*

Possible Organophosphate Formulas Used

| Structure Number | Possible Structures | Theoretical Peaks in $^{31}P$ NMR (ppm) | References |
|---|---|---|---|
| 1 | $[(RO)_2P(S)S]_2Zn$ Neutral ZDDP (secondary) | 94, 102-93, 95.8 | 1, 5 |
| 2 | $(RS)_3P(S)$,R>$CH_3$ | 92.9, 90-98 | 4, 2 |
| 3 | $(RO)(R'S)P(O)SZn^-$ | 68-90, | 2 |
| 4 | $(RO)_2(RS)PS$, R>$CH_3$ | 92-98, 94.9, 85-93 | 2, 4, 1 |
| 5 | Basic ZDDP | 102-110, 100(sec.) | 1 |
| 6 | $>P(S)SZn^-$ | 99-104 | 2 |
| 7 | $(RO)_2P(S)(SR)$ | 100 | 3 |
| | $[(RO)_2P(S)S]_2Zn$ Neutral ZDDP (primary) | 104 | 3 |
| 8 | $R(R'S)_2PS$, R=$CH_3$, R'>$CH_3$ | -74 ± 3.0 | 4 |
| 9 | $(RO)_3PS$, R=$CH_3$, R=any alkyl | -73, 50-82 | 4, 2 |
| 10 | $MeP(S)Cl_2$ | -79.8 | 4 |
| 11 | $(RO)_2(S)PSP(S)(OR)_2$ | 76-83, 78.4-83.4 | 2, 5 |
| 12 | $>P(S)(SH)$ | 78-83 | 2 |
| | $(RO)(R'S)P(O)SZn^-$ | 68-90 | 2 |
| 13 | $SPH(OCH_3)_2$ | 74 | 5 |

*FIG. 2A*
Various Organophosphate Structures
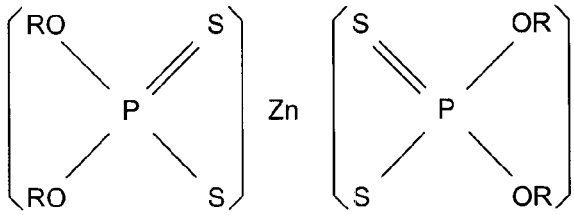
Structure 1 (Neutral ZDDP)
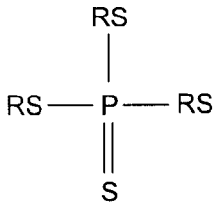
R >$CH_3$
Structure 2
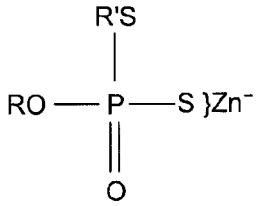
Structure 3
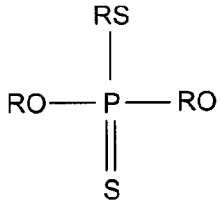
R >$CH_3$
Structure 4
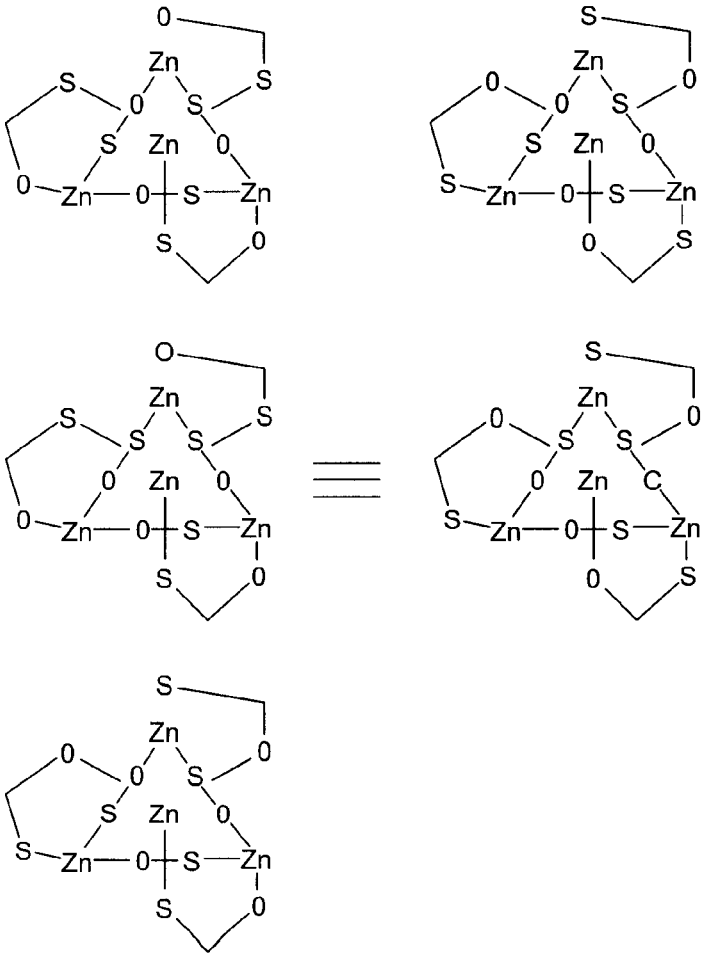
Structure 5 Many possible isomers of Basic ZDDP

FIG. 2B
Various Organophosphate Structures
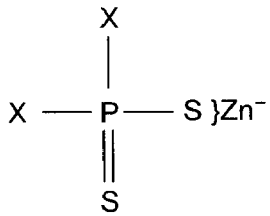
X=R, OR, SR
Structure 6
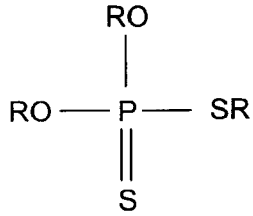
Structure 7
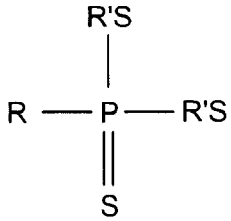
R=$CH_3$, R'>$CH_3$
Structure 8
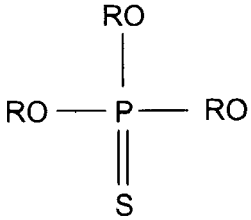
R=$CH_3$, R'=any alkyl group
Structure 9
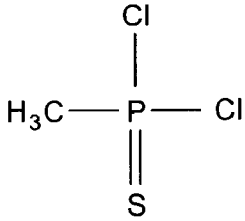
Structure 10
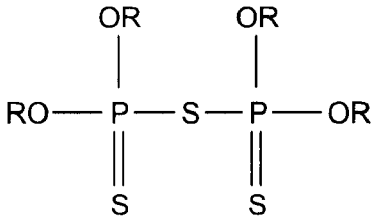
Structure 11
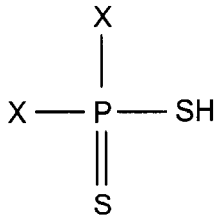
X=R, OR, SR
Structure 12
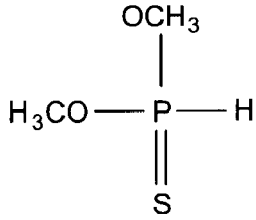
Structure 13
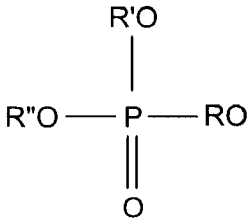
Phosphate
Structure 14
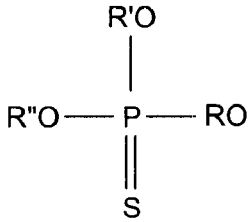
Monothio Phosphate
Structure 15
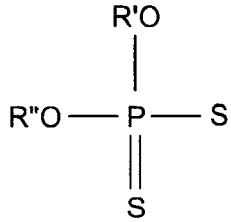
Dithio Phosphate
Structure 16
R, R', R" may be all equal or different

*FIG. 2C*
Various Organophosphate Structures
Thiopyrophosphonate
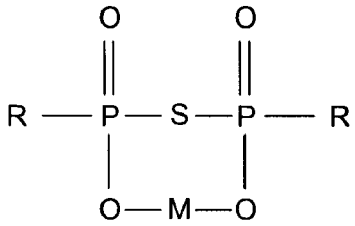
Thiophosphonates
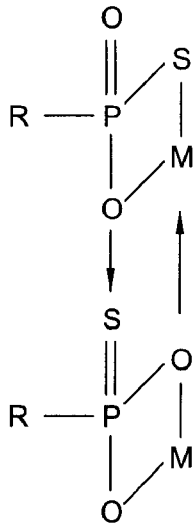
Phosphonate
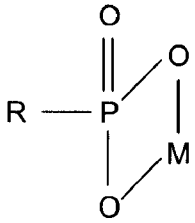
Structure 17
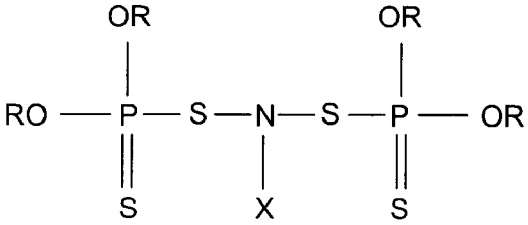
X=H or R
Amine Dialkyl Dithiophosphate
Structure 18
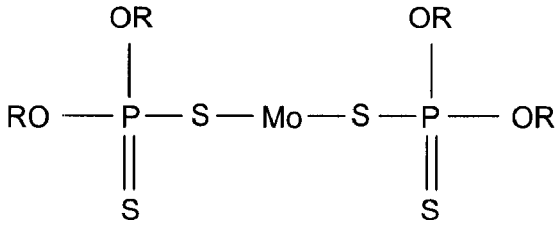
Moly Dialkyl Dithiophosphate
Structure 19
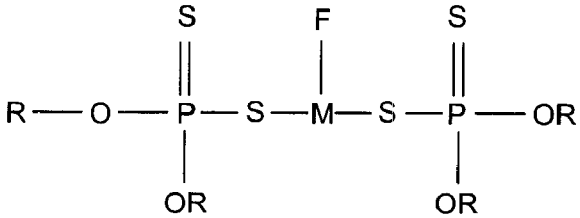
M = Fe, Zn, Cu, Mo, Sb, Ti,...
Fluorinated Metal Complex of MDDP
Structure 20

FIG. 2D
Various Organophosphate Structures
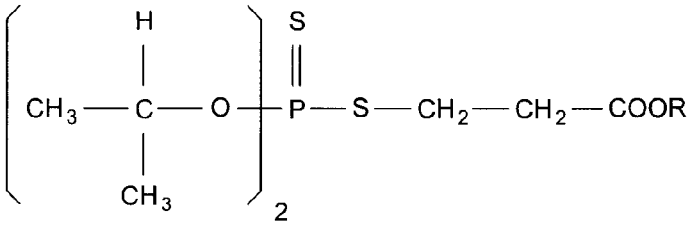
Structure 21
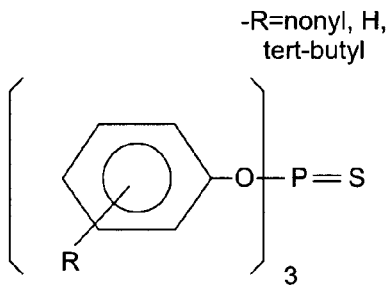
Structure 22
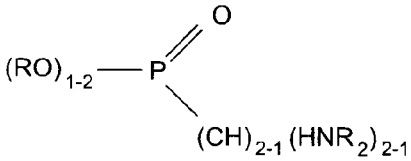
Structure 23
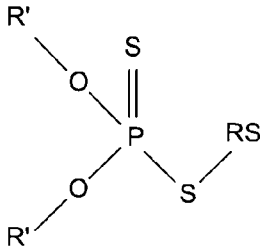
Structure 24
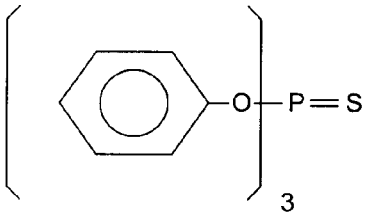
Structure 25
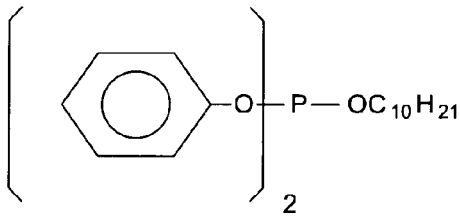
Structure 26
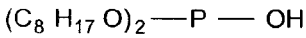
Structure 27
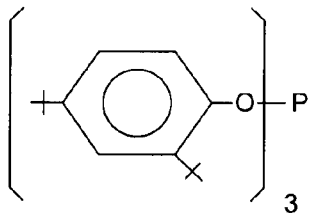
Structure 28

PTFE Structures

PTFE

Cross-linked PTFE

FI-PTFE

Reaction Products

Possible Mechanism of Reaction at Wear Surface

FI-PTFE with Carboxylic Functionality + F-ZDDP

FI-PTFE with Carboxylic Functionality + ZDDP

Possible Mechanism of Reaction at Wear Surface (cont)

FI-PTFE with Amine Functionality + F-ZDDP

FI-PTFE with Amine Functionality + ZDDP

4-Ball Weld Test Results (Cube Graph)

Note: All PTFE's are FI-PTFE

DESIGN-EXPERT Plot

Weld Load Kg
X = A: ZDDP
Y = B: PTFE
Z = C: Catalyst

Actual Factor
D: MolySulfide = 0.50

4-Ball Weld Test Results (Cube Graph)

Note: All PTFE's are FI-PTFE

DESIGN-EXPERT Plot

Weld Load Kg
X = A: ZDDP
Y = B: PTFE
Z = C: Catalyst

Actual Factor
D: MolySulfide = 1.25

4-Ball Weld Test Results (Cube Graph)

Note: All PTFE's are FI-PTFE

DESIGN-EXPERT Plot

Weld Load Kg
X = A: ZDDP
Y = B: PTFE
Z = C: Catalyst

Actual Factor
D: MolySulfide = 2.00

4-Ball Weld Test Results

FIG. 7B

4-Ball Weld Test Results

| | |
|---|---|
| 1 | 0.5 ZDDP, 0 FI-PTFE, 0.5 Mo, 0.2 Cat |
| 2 | 0.5 ZDDP, 2 FI-PTFE, 0.5 Mo, 0.2 Cat |
| 3 | 2 ZDDP, 0 FI-PTFE, 0.5 Mo, 0.2 Cat |
| 4 | 0.5 ZDDP, 2 FI-PTFE, 2 Mo, 0.2 Cat |
| 5 | 1 Cat, 2 Mo |
| 6 | 3.0 F-ZDDP, 0.5 Mo |
| 7 | 0.5 ZDDP, 0 FI-PTFE, 0.5 Mo, 1 Cat |
| 8 | 2 ZDDP, 0 FI-PTFE, 2 Mo, 0.2 Cat |
| 9 | 2 ZDDP, 0 FI-PTFE, 0.5 Mo, 1 Cat |
| 10 | 0.5 ZDDP, 0 FI-PTFE, 2 Mo, 0.2 Cat |
| 11 | 2 ZDDP, 2 FI-PTFE, 0.5 Mo, 1 Cat |
| 12 | 0.5 ZDDP, 2 FI-PTFE, 0.5 Mo, 1 Cat |
| 13 | 2 Mo |
| 14 | 3.0 F-ZDDP, 2 FI-PTFE, 0.5 Mo |
| 15 | 0.5 ZDDP, 2 Mo, 1 Cat |
| 16 | 2 ZDDP, 0 FI-PTFE, 2 Mo, 1 Cat |
| 17 | 2 ZDDP, 2 FI-PTFE, 2 Mo, 1 Cat |
| 18 | 0.5 ZDDP, 2 FI-PTFE, 2 Mo, 1 Cat |
| 19 | 1.25 ZDDP, 1 FI-PTFE, 1.25 Mo, 0.6 Cat |
| 20 | 2 ZDDP, 2 FI-PTFE, 0.5 Mo, 0.2 Cat |
| 21 | 2 ZDDP, 2 FI-PTFE, 0 Mo, 0.2 Cat |
| 22 | 2 ZDDP, 2 FI-PTFE, 0 Mo, 0 Cat |
| 23 | 3 ZDDP, 2 FI-PTFE, 0 Mo, 0 Cat |
| 24 | 2 ZDDP, 2 FI-PTFE, 2 Mo, 0.2 Cat |

Block on Cylinder Test Results

Block on Cylinder Test Results (NOTE: ALL PTFE's ARE FI-PTFE)

*FIG. 10*
3-Dimensional Predictions of Wear Scar
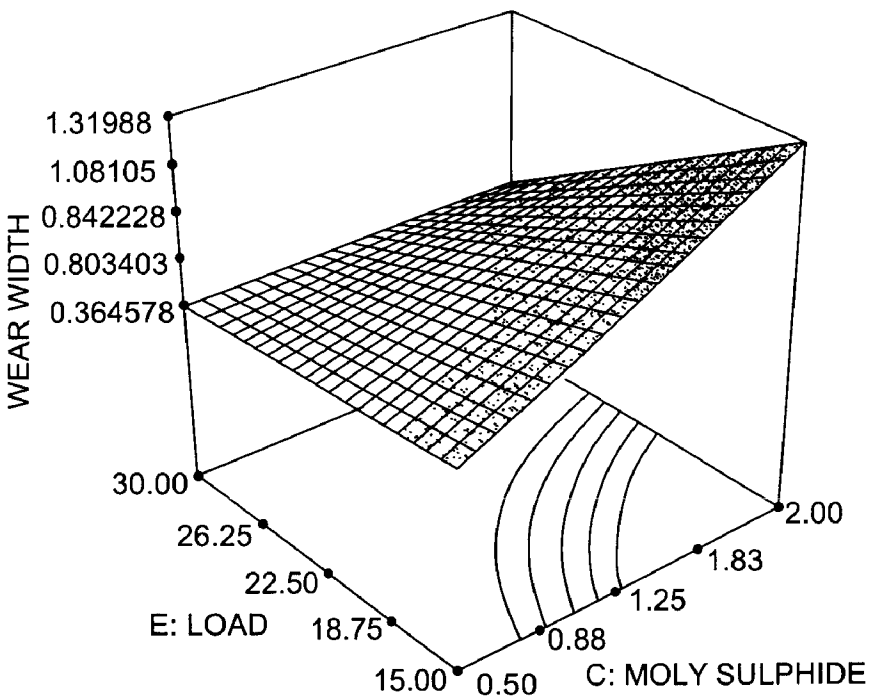
2 ZDDP + 1.0 FI-PTFE + 0.2 CATALYST
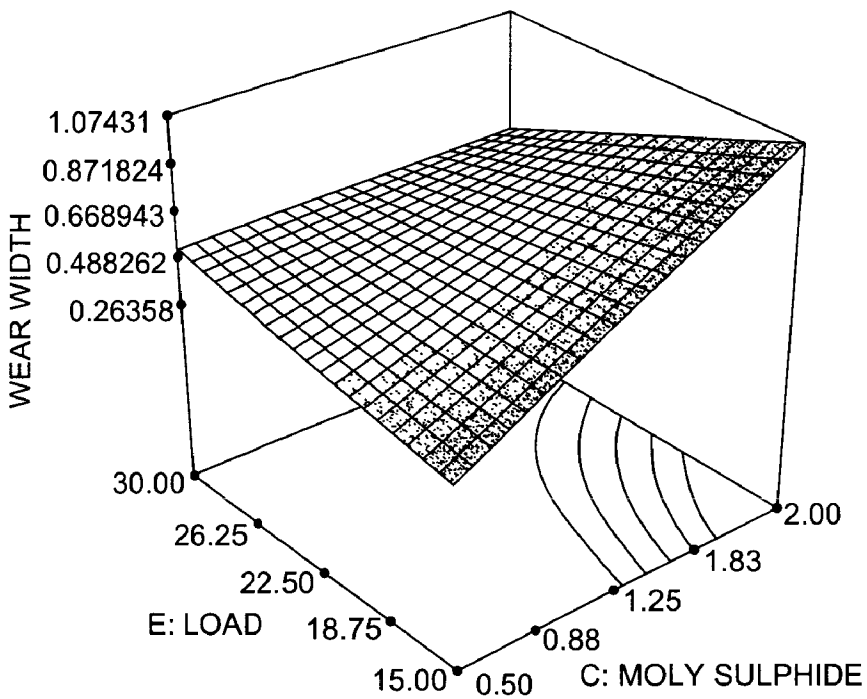
0.5 ZDDP + 1.0 FI-PTFE + 0.2 CATALYST Differential Scanning Calorimetry on ZDDP Decomposition (NOTE: ALL PTFE's ARE FI-PTFE)

4-Ball Wear Test Results

4-Ball Load Wear Index Results

4-Ball Weld Test Results

4-Ball Wear Test Results with Sulphurized Additives 40 and 80 Kg 4-Ball Wear Tests Block on Cylinder Wear Test Results

HIGH PERFORMANCE LUBRICANTS AND LUBRICANT ADDITIVES FOR CRANKCASE OILS, GREASES, GEAR OILS AND TRANSMISSION OILS

CROSS-REFERENCE TO RELATED APPLICATIONS

This application is a continuation-in-part of U.S. patent application Ser. No. 11/259,635, entitled "HIGH PERFORMANCE LUBRICANT ADDITIVES," filed Oct. 26, 2005, and which is incorporated by reference herein.

This application also incorporates by reference co-pending U.S. patent application Ser. No. 11/871,033, entitled "HIGH PERFORMANCE LUBRICANTS AND LUBRICANT ADDITIVES FOR CRANKCASE OILS, GREASES, GEAR OILS AND TRANSMISSION OILS," filed concurrently herewith, and which is incorporated by reference herein.

TECHNICAL FIELD

The present application relates generally to lubricants and, more particularly, to improving the quality of lubricants through the use of high-performance lubricant additives that enhance desirable lubricant properties of lubricants.

BACKGROUND OF THE INVENTION

Lubricants comprise a variety of additives in a base mixture selected for desirable characteristics such as anti-wear and anti-friction properties. Often commercial lubricants are compositions containing a lubricant base such as a hydrocarbon base oil or base grease (oil to which a thickener has been added to form a solid), to which are added numerous lubricant additives selected for additional desirable properties. Lubricant additives may enhance the lubricity of the lubricant base and/or may provide anti-wear or other desirable characteristics.

Lubricants are used in enormous quantities. For example, more than four billion quarts of crankcase oil are used in the United States per year. However, many lubricants currently in use also have undesirable characteristics. Currently available crankcase oils generally include the anti-wear additive zinc dialkyldithiophosphate (ZDDP), which contains phosphorous and sulfur. Phosphorous and sulfur poison catalytic converters causing increased automotive emissions. It is expected that the automotive industry will eventually mandate the total elimination of phosphorous and/or sulfur, or will allow only extremely low levels of phosphorous and/or sulfur in crankcase oil. However, no acceptable anti-wear additives to replace ZDDP in engine oils are currently available. Greases require both anti-wear and extreme pressure (EP) characteristics. These characteristics are measured in 4-ball testing machines. Anti-wear behavior is measured by the size of the wear scar in 4-ball wear tests, while EP is measured by weld load and Load Wear Index (LWI) in the 4-ball weld tests. It is extremely difficult to simultaneously achieve both good anti-wear and good EP characteristics in a single grease.

Additionally, lubricant bases used in conventional lubricants usually have lubricant additives added to them to improve lubricity and other performance characteristics. Many of these lubricant additives do not provide sufficient additional lubricity or other performance characteristics, and/or possess additional undesirable characteristics.

Accordingly, it is an object of the present invention to provide environmentally-friendly anti-wear additives for lubricants, wherein the amounts of phosphorous and sulfur which are contributed by the anti-wear additive to the lubricant are significantly reduced and approach zero. It is another object of the present invention to produce additives with desirable anti-wear and anti-friction characteristics. It is another object of the present invention to provide improved anti-wear and EP characteristics in greases.

BRIEF SUMMARY OF THE INVENTION

Embodiments of the invention comprise methods for preparing lubricant additives and lubricants by mixing or reacting together organophosphates such as zinc dialkyldithiophosphate (ZDDP) and organofluorine compounds such as polytetrafluoroethylene (PTFE). PTFE molecules used with embodiments of the present invention comprise more than 40 carbon atoms. The invention utilizes a synergistic effect between the ZDDP and functionalized, irradiated PTFE (FI-PTFE), and can occur either as a mixture of ZDDP and FI-PTFE, or as a reaction product of ZDDP and FI-PTFE. The invention also utilizes a synergistic effect between fluorinated ZDDP and sulphurized additives. In one embodiment, FI-PTFE and either ZDDP or fluorinated ZDDP are mixed together at about 25° C. In another embodiment, either ZDDP or fluorinated ZDDP and FI-PTFE are reacted together at about 40° C. to about 125° C. In a preferred embodiment, either ZDDP or fluorinated ZDDP and FI-PTFE are reacted together at a temperature of about 60° C. to about 125° C. The reaction is allowed to continue from about 20 minutes to about 24 hours. In this embodiment, both supernatants and precipitates may be formed during the reaction and may be used as lubricant additives. Either the supernatants or a mixture of the supernatants and the precipitates may also be added to lubricant bases. The lubricant base includes hydrocarbon bases with or without additives. In some embodiments the lubricant base may have sufficient additives to be classified as engine oils, greases, gear oils, transmission fluids, etc. Lubricant in this disclosure includes both liquid and solid lubricants. Likewise, lubricant base includes a liquid lubricant base as well as a grease base. The precipitates also may be added to greases. In certain embodiments, organophosphates and organofluorine compounds can be added to a lubricant base and then allowed to react under specified conditions.

Other embodiments of the present invention react a mixture of powdered metal halide with an organophosphate such as ZDDP, yielding a fluorinated organothiophosphate. This fluorinated organothiophosphate is then mixed with an organofluorine such as FI-PTFE to form a lubricant additive or lubricant. In yet other embodiments, other forms of metal halide may be used that are not powdered. The metal halide used is metal fluoride in a preferred embodiment of the invention. The most preferred metal fluoride is iron fluoride. In a preferred embodiment, the metal fluoride and ZDDP are reacted together at about 25° C. to about 125° C. to form a fluorinated organothiophosphate (produced by the methods described in U.S. patent applications Ser. No. 11/221,400, filed Sep. 7, 2005, titled LOW-PHOSPHOROUS LUBRICANTS, or Ser. No. 11/446,820, filed Jun. 5, 2006, titled METHOD TO SYNTHESIZE FLUORINATED ZDDP, the disclosures of which are incorporated herein by reference). The supernatant from the reaction is then mixed with an FI-PTFE, and the mixture may be used as a lubricant additive. The lubricant additive is then added to a lubricant base.

Other embodiments of the present invention react a mixture of powdered metal halide with an organophosphate such as ZDDP, yielding a fluorinated organothiophosphate. This fluorinated organothiophosphate is then mixed with a sulphurized additive such as Vanlube 972M (a thiodiazole) or other thiodiazoles to form a lubricant additive or lubricant. In yet other embodiments, other forms of metal halide may be used that are not powdered. The metal halide used is metal fluoride in a preferred embodiment of the invention. The most preferred metal fluoride is iron fluoride. In a preferred embodiment, the metal fluoride and ZDDP are reacted together at about 25° C. to about 125° C. to form a fluorinated organothiophosphate (produced by the methods described in U. S. patent applications Ser. No. 11/221,400, filed Sep. 7, 2007, titled LOW-PHOSPHOROUS LUBRICANTS, or Ser. No. 11/446,820, filed Jun. 5, 2006, titled METHOD TO SYNTHESIZE FLUORINATED ZDDP, the disclosures of which are herein incorporated by reference). The supernatant from the reaction is then mixed with a sulphurized additive, and the mixture may be used as a lubricant additive. The lubricant additive is then added to a lubricant base.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which:

FIG. 1 is a table of possible organophosphate formulas used with certain embodiments of the present invention;

FIGS. 2A-D show various organophosphate structures used with certain embodiments of the present invention;

FIGS. 7A and 7B are charts summarizing the results of ASTM D2596 4-Ball Weld Load experiments used to generate the cube graphs of FIGS. 6A-6C;

FIG. 10 shows 3-dimensional predictions of wear scar dimensions based on experimental results from block on cylinder tests comparing grease compositions;

DETAILED DESCRIPTION OF THE INVENTION

Figure 3A:
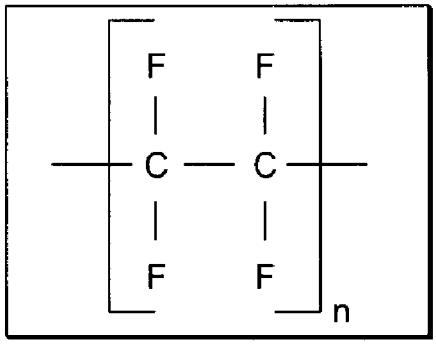
FIG. 3 shows PTFE and FI-PTFE structures used with certain embodiments of the present invention.

Embodiments of the present invention provide improved high performance lubricant additives and lubricants that provide enhanced wear protection, lower coefficients of friction, and low cohesive energy surfaces. Lubricant additives provided according to embodiments of the present invention may be added to lubricant bases to produce lubricants such as greases, crankcase oils, hydrocarbon solvents, etc. Embodiments of the present invention generally mix and/or react together organophosphate compounds and organofluorine compounds, with or without metal halide and/or molybdenum disulfide and/or thiodiazole, to produce lubricant additives.

FIG. 1 is a table showing several of the organophosphate compounds that may be used with embodiments of the present invention. Generally, dithiophosphates and ammonium and amine salts of monothiophosphates and dithiophosphates may be used. Metal organophosphates and organothiophosphates such as zinc dialkyldithiophosphate (ZDDP) are encompassed by the term "organophosphate" for the purposes of this disclosure. Other organophosphates listed in FIG. 1 include neutral ZDDP (primary), neutral ZDDP (secondary), basic ZDDP (primary and secondary), $(RS)_3P(s)$ where $R>CH_3$, $(RO)(R'S)P(O)SZn^-$, $(RO)_2(RS)PS$ where $R>CH_3$, $P(S)(S)Zn^-$, $(RO)_2P(S)(SR)$, $R(R'S)_2PS$ where $R=CH_3$ and $R'>CH_3$, $(RO)_3PS$ where $R=CH_3$ and R'=alkyl, $MeP(S)Cl_2$, $(RO)_2(S)PSP(S)(OR)_2$, P(S)(SH), $(RO)(R'S)P(O)SZn^-$, $SPH(OCH_3)_2$, where R= any alkyl and R'= any alkyl, and combinations thereof. The chemical structures of representative compounds from FIG. 1 and additional organophosphate compounds that may be used with the invention are shown in FIGS. 2A-2C. In certain embodiments of the present invention, organophosphates not shown in FIGS. 1 and 2A-2C may be used.

The organophosphate ZDDP is used in preferred embodiments of the present invention. Embodiments using ZDDP, alone or in combination with other organophosphates, can use ZDDP in one or more moieties. Preferably, the ZDDP used is the neutral or basic moiety or mixtures of same. Some of the ZDDP moieties are shown in FIG. 2A as structures 1 and 5. In a preferred embodiment, the ZDDP alkyl groups contain approximately 1-20 carbon atoms. The alkyl groups of the ZDDP can assume various forms known to those of skill in the art such as branched- or straight-chain primary, secondary, or tertiary alkyl groups.

Additional organophosphate structures that may be usable with embodiments of the present invention are shown in FIGS. 2C-D. The organophosphate structures specifically disclosed herein are representative structures and are in no way intended to limit embodiments of the present invention to those structures. Many embodiments of the present invention utilize organophosphate compounds not specifically shown.

Also used in preferred embodiments is a functionalized, electron-beam irradiated PTFE (FI-PTFE). FI-PTFE comprises additional active end groups formed by carrying out the irradiation process in an air environment. During the process, the long-chain PTFE molecules are cleaved to form shorter-chain molecules with polar end-groups such as carboxyl groups. Charged PTFE molecules with carboxyl groups present can be attracted to metal surfaces, as explained in SAE Publication No. 952475 entitled "Mechanism Studies with Special Boundary Lubricant Chemistry" by Shaub et al., and SAE Publication No. 941983 entitled "Engine Durability, Emissions and Fuel Economy Studies with Special Boundary Lubricant Chemistry" by Shaub et al., the contents of which are herein incorporated by reference (see FIG. 3C). FI-PTFE combined with an organophosphate such as, for example, ZDDP, can enhance the rate of decomposition of ZDDP and form reaction products that are usable as high-performance lubricant additives.

Figure 3B:
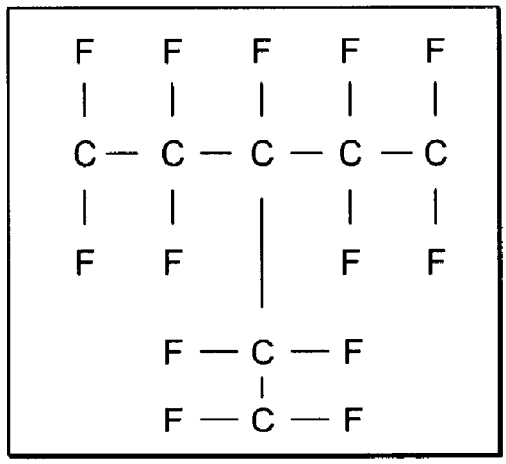

A variety of organofluorine compounds are usable with the present invention. Functionalized, irradiated derivatives of Polytetrafluoroethylene (PTFE) are particularly suited for use with embodiments of the present invention. PTFE structures are shown in FIG. 3. Other organofluorine compounds that are usable include, but are not limited to, fluoroalkyl carboxylic acids, fluoroaryl carboxylic acids, fluoroalkylaryl carboxylic acids, and the like; compositions comprising fluoroalkyl sulfonic acids, fluoroaryl sulfonic acids, or fluoroalkylaryl sulfonic acids, and the like, and their derivatives, such as alkyl and fluoroalkyl esters and alkyl, or fluoroalkyl alcohols and alkyl, or flouroalkyl amides. Particularly preferred compositions are those described above that have at least one functional group, such as carboxylic acids, sulfonic acids, esters, alcohols, amines and amides, or mixtures thereof. Organofluorine compounds can be partially fluorinated or completely fluorinated. Certain of these organofluorine compounds can enhance or accelerate the decomposition of organophosphate and organothiophosphate materials. Likewise, these compositions can react with metal fluorides, such as $FeF_3$ and $TiF_3$, $ZrF_4$, $AlF_3$ and the like (as disclosed in U.S. patent application Ser. No. 08/639,196, filed Apr. 26, 1996, title CATALYZED LUBRICANT ADDITIVES AND CATALYZED LUBRICANT SYSTEMS DESIGNED TO ACCELERATE THE LUBRICANT BONDING REACTION, issued as U.S. Pat. No. 5,877,128 on Mar. 2, 1999, the disclosure of which is incorporated herein by reference). In general, the molecules of organofluorine materials will contain at least 40 carbon atoms and can be of high, low or moderate molecular weight.

Certain embodiments of the present invention comprise methods for preparing lubricant additives by mixing together zinc dialkyldithiophosphate (ZDDP) and functionalized, irradiated polytetrafluoroethylene (FI-PTFE), where the FI-PTFE molecules comprises greater than 40 carbon atoms. FI-PTFE molecules comprising greater than 40 carbon atoms are particularly suited for use with embodiments of the present invention, as this type of FI-PTFE is generally insoluble in mineral oils and other lubricants. A preferred embodiment of the present invention uses FI-PTFE molecules with a composition of between 40 and 6000 carbon atoms. The mixture or components thereof can then be added to a base lubricant as a lubricant additive to improve various characteristics of the base lubricant (such as engine oil, grease, or transmission oil). In preferred embodiments, the result of adding FI-PTFE and ZDDP to the lubricant base is a finished lubricant having about 0.01 weight percent phosphorous to about 0.5 weight percent phosphorous.

In certain embodiments, once combined, the ZDDP and FI-PTFE are reacted together by baking at a temperature of about 40° C. to about 125° C. In a preferred embodiment, the reactant mixture is reacted at a temperature of about 60° C. to about 125° C. The reaction is allowed to continue from about 20 minutes to about 24 hours. Generally, as temperature is decreased in embodiments of the invention, the duration of the reaction is increased. Various additional reaction parameters may be used, such as performing the reaction under certain gases such as air, oxygen, nitrogen or noble gases, or stirring the reactants to encourage reaction progress, or by applying ultrasonification to effect faster reactions. Both supernatants and precipitates formed during a reaction may be used as lubricant additives in certain embodiments of the present invention. Supernatants and precipitates may be separated using standard techniques such as filtration or centrifugation known to those skilled in the art.

Certain embodiments of the present invention comprise methods for preparing lubricant additives by reacting together fluorinated zinc dialkyldithiophosphate (F-ZDDP) and functionalized, irradiated polytetrafluoroethylene (FI-PTFE), where the FI-PTFE molecules comprises greater than 40 carbon atoms. FI-PTFE molecules comprising greater than 40 carbon atoms are particularly suited for use with embodiments of the present invention, as this type of FI-PTFE is generally insoluble in mineral oils and other lubricants. A preferred embodiment of the present invention uses FI-PTFE molecules with a composition of between 40 and 6000 carbon atoms. A reaction between FI-PTFE and fluorinated ZDDP according to embodiments of the present invention may take place outside of a lubricant environment, producing a product mixture. The product mixture or components thereof can then be added to a base lubricant as a lubricant additive to improve various characteristics of the base lubricant (such as engine oil, grease, or transmission oil). In preferred embodiments, the result of adding FI-PTFE and F-ZDDP to the lubricant base is a finished lubricant having about 0.01 weight percent phosphorous to about 0.5 weight percent phosphorous.

Figure 4A:
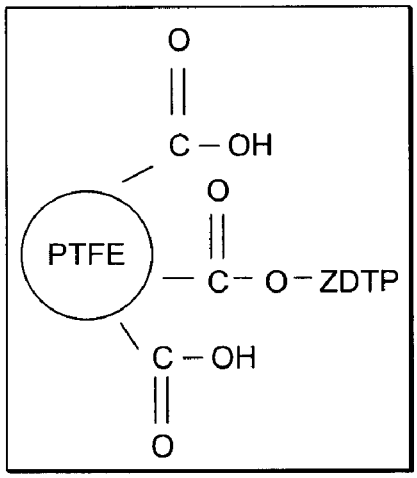
FIGS. 4A-C show reaction products of certain embodiments of the present invention.
Figure 4B:
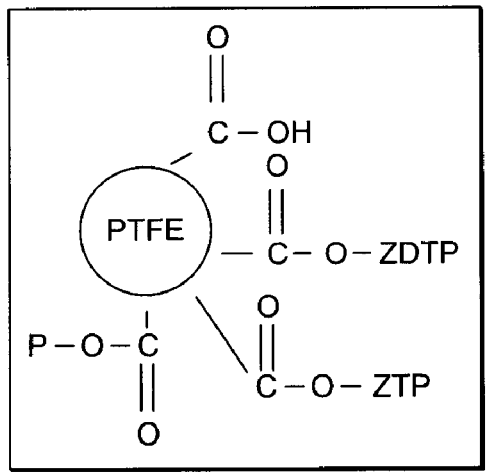
Figure 4C:
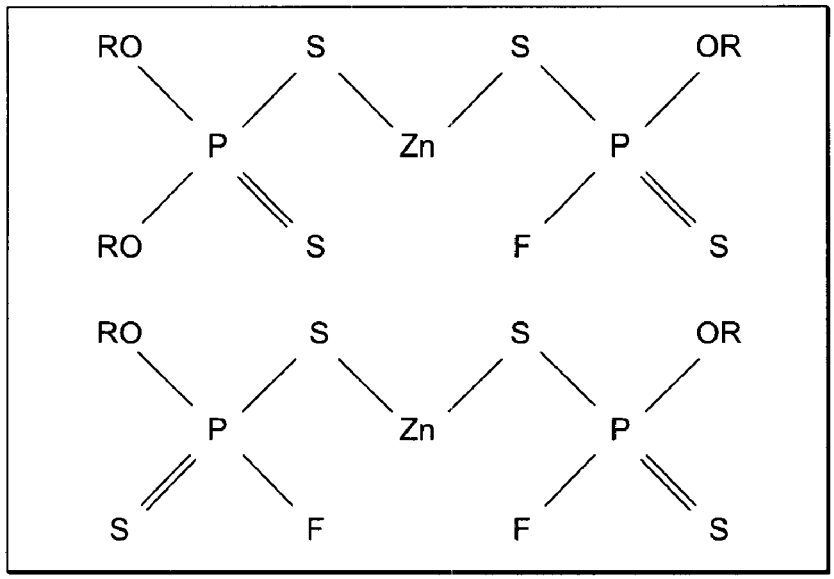
Figure 5B:
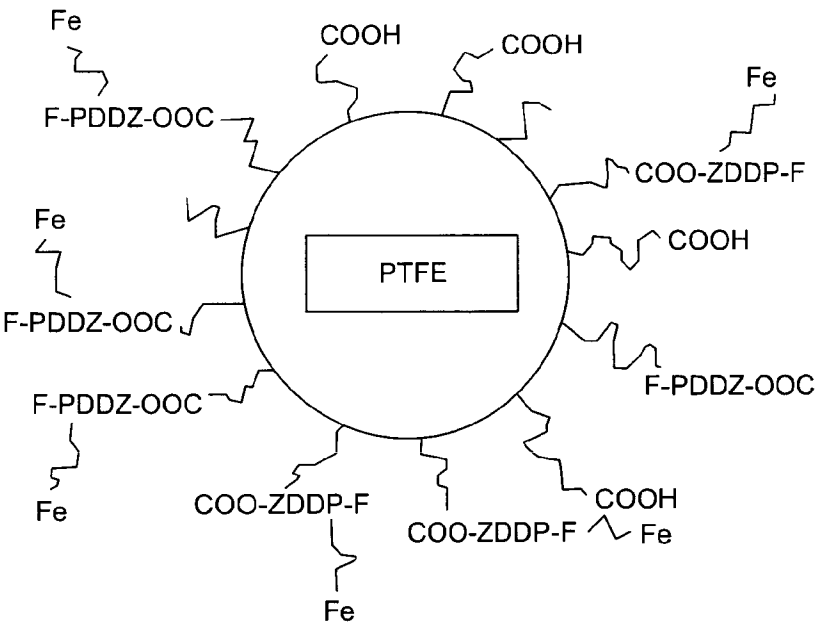
FIGS. 5A-D show the possible mechanism of the reaction at the wear surface.
Figure 5A:
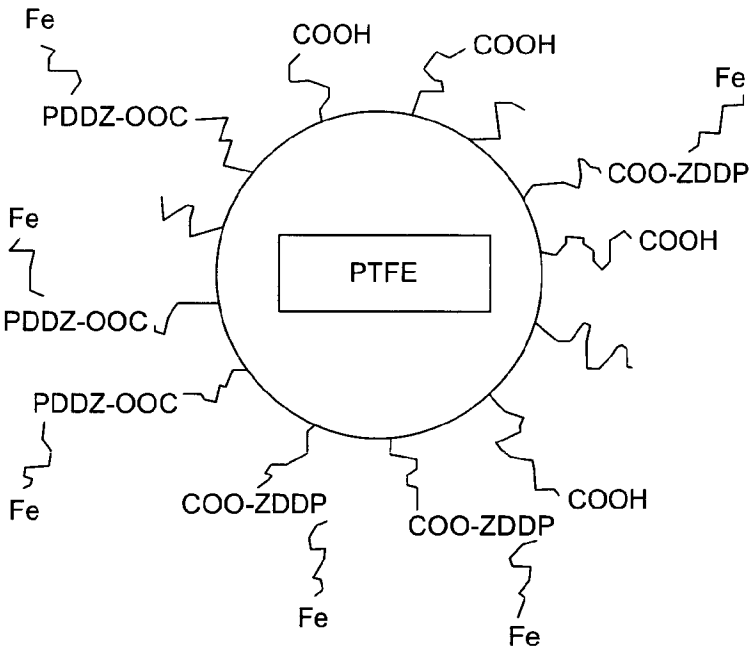
Figure 5D:
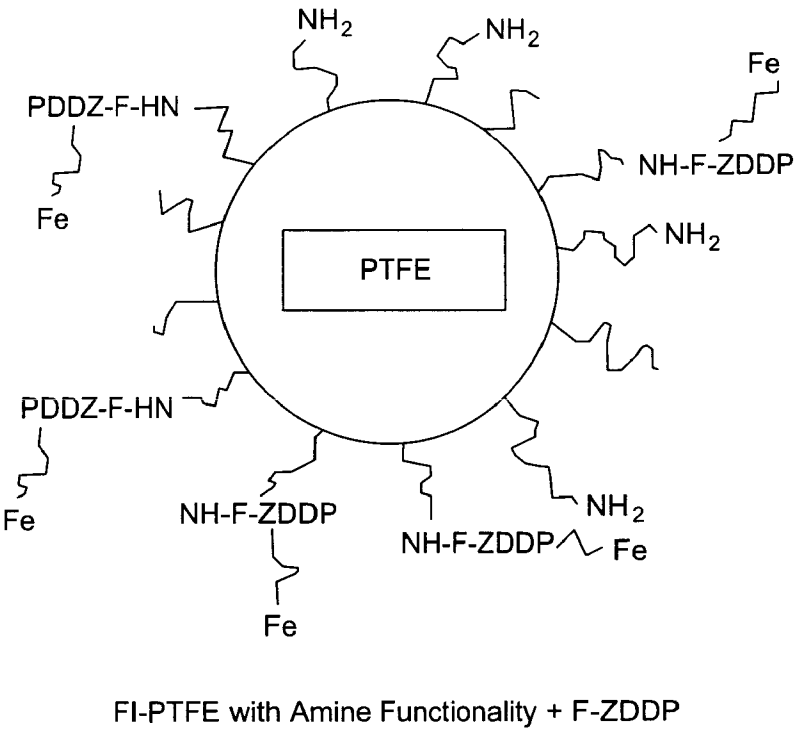
Figure 5C:
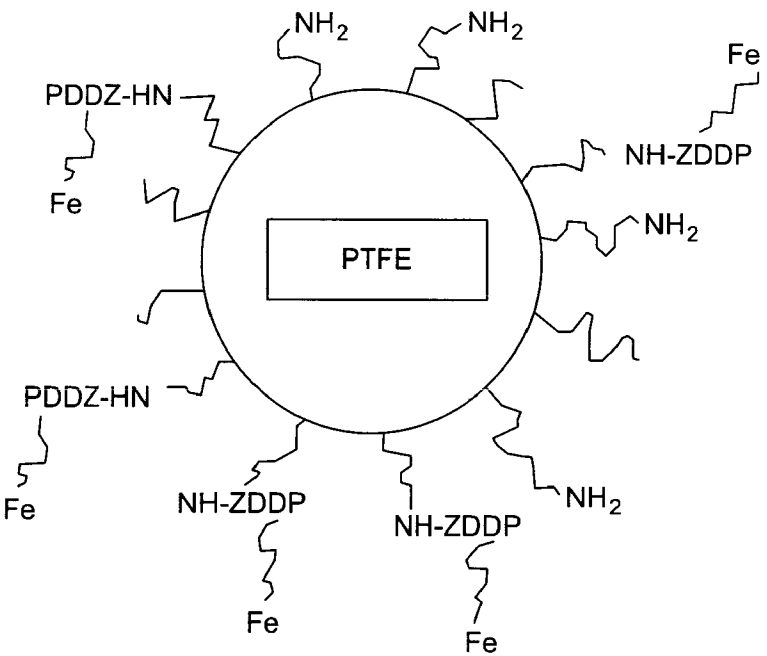

In a preferred embodiment, an intent of the reaction as described above is to produce two products. One is a clear decant liquid which comprises neutral ZDDP, fluorinated ZDDP and/or a FI-PTFE complex that has attached ZDDP, phosphate, and thiophosphate groups. The clear liquid decant can be used for oils to produce a low-phosphorous, high performance additive and in greases as a high performance additive. The second product comprising settled or centrifuged solid products comprises predominantly FI-PTFE and FI-PTFE complexes with ZDDP, phosphates and thiophosphates, and can be used as a grease additive. Both of the reaction products are believed to have affinity for metal surfaces. When used (or formed, as described further below) in a lubricating composition, the reaction products bind to, or concentrate on, the metal surface, providing wear and friction protection. FIGS. 4A and 4B show FI-PTFE/ZDDP complexes that are possible reaction products that may form in certain embodiments of the present invention. However, these are only an exemplary product and additional structures may be formed in these or other embodiments of the present invention. Although ZDDP and FI-PTFE are a focus of the discussion above, other organophosphates and organofluorine compounds are expected to produce similar reaction products usable as high-performance additives.

In certain embodiments, one or more compounds with reactivity, so as to accelerate or effect a reaction, can be added to a reaction mixture of ZDDP and FI-PTFE. These reactive agents can speed up the reaction with ZDDP, FI-PTFE, or both, or other materials with these compositions, to give new lubricant additives. Metal halides such as ferric fluoride are reactive materials used in preferred embodiments of the present invention. Metal halides used with certain embodiments of the present invention may be, for example, aluminum trifluoride, zirconium tetrafluoride, titanium trifluoride, titanium tetrafluoride, and combinations thereof. In other embodiments, other transition metal halides are used, such as, for example, chromium difluoride and trifluoride, nickel difluoride, stannous difluoride and tetrafluoride, and combinations thereof. Ferric fluoride may be produced according to a process described in co-pending U.S. patent application Ser. No. 10/662,992 filed Sep. 15, 2003, titled PROCESS FOR THE PRODUCTION OF METAL FLUORIDE MATERIALS, the contents of which are herein incorporated by reference. In embodiments that react metal halides with ZDDP and FI-PTFE, resulting reaction mixtures may comprise both solid and liquid phase components. Liquid phase product comprising fluorinated ZDDP and FI-PTFE complexes with attached ZDDP, phosphate, and thiophosphate groups can be used to produce low-phosphorous engine oils and high-performance greases. Solid phase product comprising settled or centrifuged solid products comprises predominantly FI-PTFE and unreacted ferric fluoride and can be used as a grease additive. Both of the reaction products are believed to have affinity for metal surfaces. Solid phase components may also be similar to those illustrated in FIGS. 4A and 4B. Additional compounds may result from such reactions that may have minor lubricating characteristics.

Figure 3C:
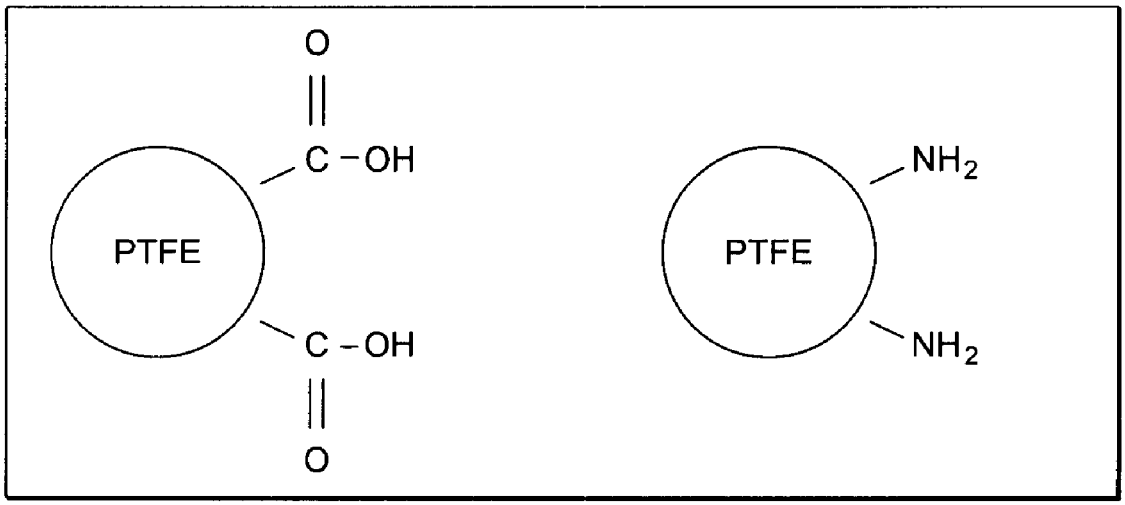

Organofluorine compounds such as FI-PTFE compounds used in embodiments of the present invention can be of various molecular weights and of various particle sizes. FI-PTFE molecular weights of about 2500 to about 300,000 are used in certain embodiments of the invention. FI-PTFE particle sizes in certain embodiments of the present invention range from about 50 nm to about 10 μm. In preferred embodiments, the FI-PTFE used is added as a solid in the form of approximately 50-500 nm diameter particles. FIG. 3C shows exemplary molecular structures of PTFE that may be used in certain embodiments of the present invention. Possible mechanism of reacting at the wear surface include FI-PTFE with carboxylic functionality or amine functionality (FIG. 5A-D) together with ZDDP or F-ZDDP.

Other embodiments of the present invention comprise adding a mixture of FI-PTFE and ZDDP to a base lubricant. FI-PTFE molecules comprising greater than 40 carbon atoms are particularly suited for use with embodiments of the present invention, as this type of FI-PTFE is generally insoluble in mineral oils and other lubricants. A preferred embodiment of the present invention uses FI-PTFE molecules with a composition of between 40 and 6000 carbon atoms. In preferred embodiments, the result of adding FI-PTFE and ZDDP to the lubricant base is a finished lubricant of about 0.01 weight percent phosphorous to about 0.5 weight percent phosphorous. In a preferred embodiment, FI-PTFE and either ZDDP or fluorinated ZDDP are mixed together at about room temperature and the resulting mixture is added to a grease.

FI-PTFE is particularly suited for use with reaction mixtures comprising organophosphates and metal halides, as it interacts strongly with such compounds resulting in reaction products usable as high performance lubricant additives. Medium to high molecular weight perfluoro alkyl carboxylic acids, or substantially fluorinated alkyl, aryl, or alkylaryl carboxylic acids are also particularly suited for use with embodiments of the present invention. Organofluorine compounds such as fluoroalkyl, fluoroalkylaryl, fluoroaryl, and fluoroarylalkyl alcohols and amines of all molecular weights are also usable with embodiments of the present invention. Particularly preferred compositions are those described above that have at least one functional group, such as carboxylic acids, sulfonic acids, esters, alcohols, amines and amides or mixtures thereof.

In a preferred embodiment of the present invention, a lubricant additive or additives produced as described above are mixed with a fully formulated engine oil without ZDDP. The term "fully formulated oil" as used here to illustrate certain embodiments of the present invention are engine oils that include other, typically used engine oil additives, but not ZDDP. In certain embodiments, the fully formulated oil may be, for example, an ILSAC (International Lubricant Standards and Approval Committee) GF4 oil with an additive package comprising standard additives, such as dispersants, detergents, and anti-oxidants, but without ZDDP. A reaction between ZDDP and FI-PTFE can then be obtained before or during the intended use of the lubricant. It should be noted that the lubricant additive or additives produced as described above may also be mixed with a lubricant base.

Figure 6A:
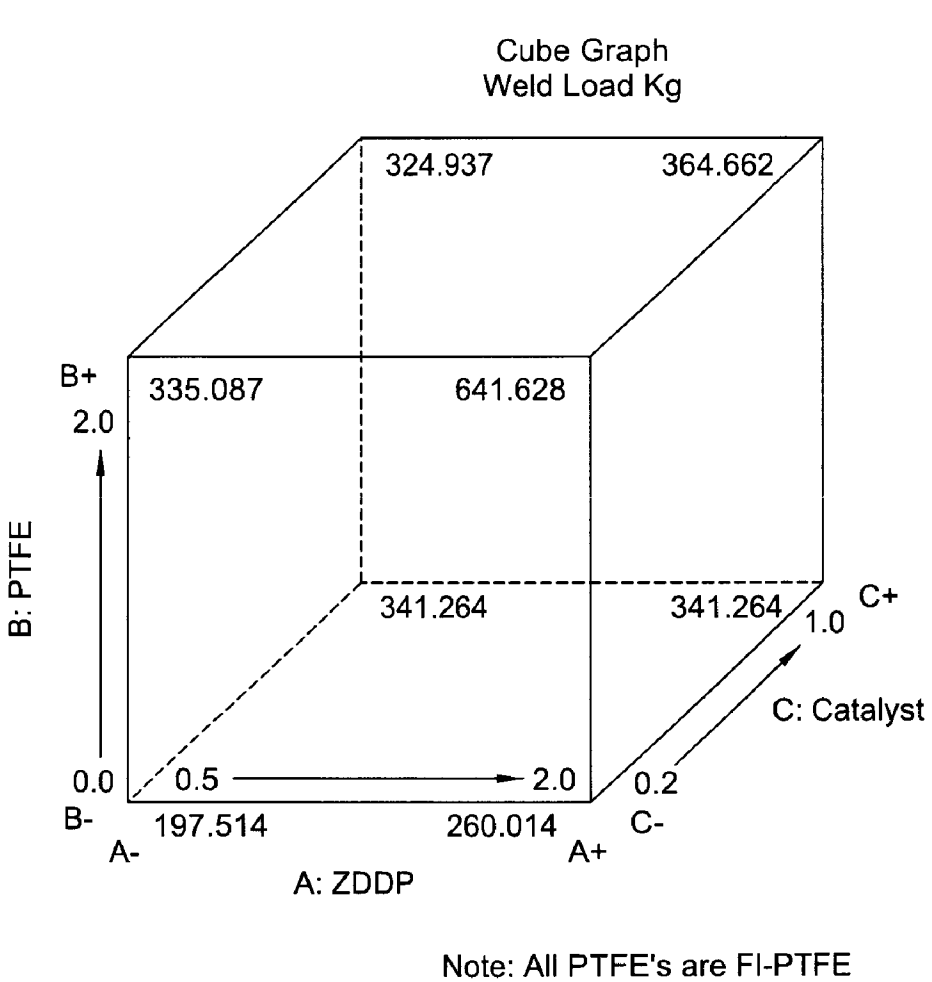
FIGS. 6A-6C show graphs illustrating the results of ASTM D2596 4-Ball Weld Load experiments in which lubricant grease containing various quantities of ZDDP, FI-PTFE, catalyst, and/or molybdenum disulfide were present.
Figure 6B:
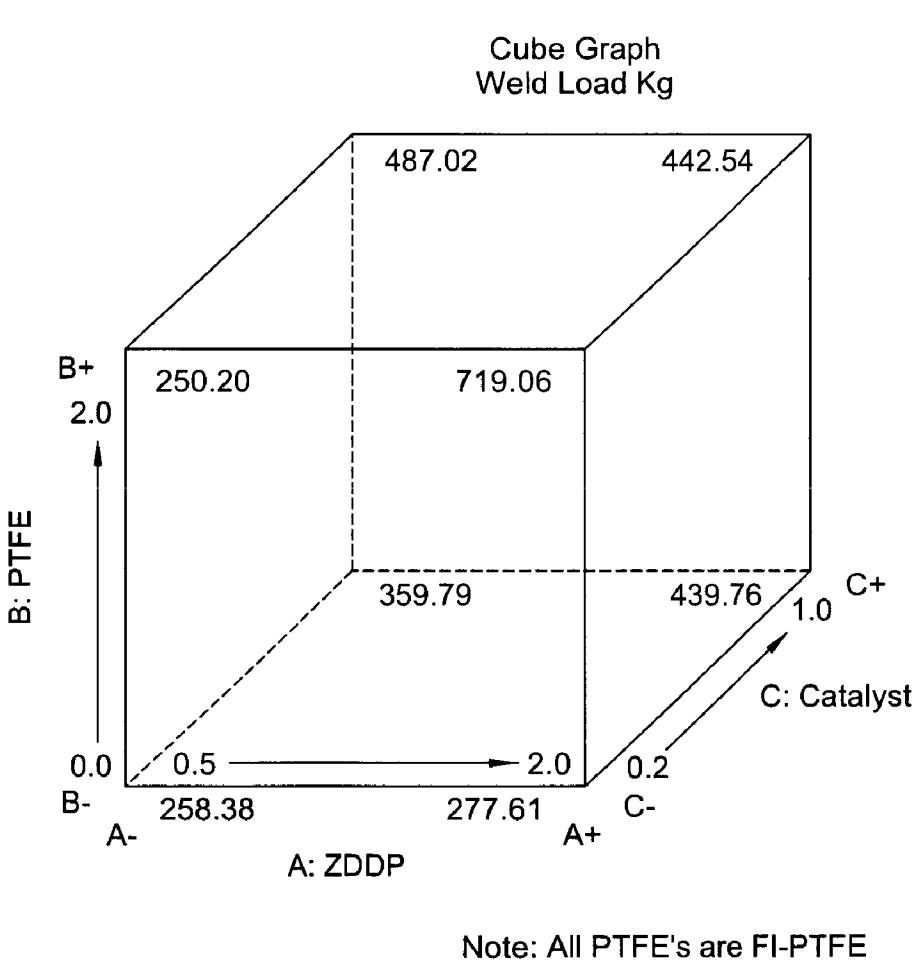
Figure 6C:
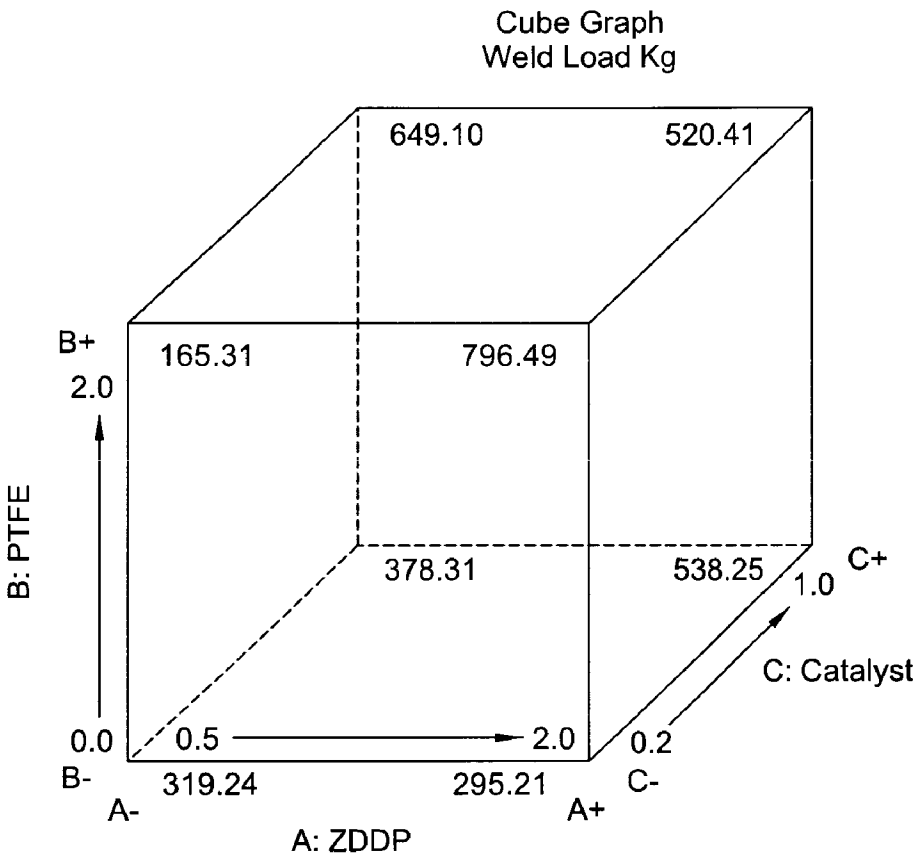

In certain embodiments of the present invention, a reaction between an organophosphate and an organofluorine further comprises interaction of the reactants with molybdenum disulfide as a reactant or catalyst. In yet other embodiments, a metal halide composition is added to the mixture to further enhance lubricant properties of the resulting reaction products. As shown below in the experimental results of FIGS. 6A-6C, molybdenum disulfide can enhance the lubricant properties of lubricant additives by the formation of possible molybdenum disulfide complexes with reaction products formed by the organophosphate and organofluorine reactants. However, other mechanisms may be responsible for the synergistic effect of molybdenum disulfide as illustrated in FIGS. 6A-6C. Synergistic effects occur, for example, when a first compound alone produces a first effect and a second compound alone produces a second effect, but the compounds combined together produce an effect that is greater than the sum of the effects of the compounds when used alone.

Below are presented the results from a series of experiments that were performed to determine the properties of lubricants and lubricant additives produced according to embodiments of the present invention.

4-Ball Weld Test (ASTM D2596)

This experimental protocol measures the extreme-pressure properties of lubricants such as greases. A top ball rotating at 1800 rpm is placed in sliding contact with three other, lower, balls. The contact force between the top ball and the other three lower balls is adjustable, and the entire 4-ball assembly is bathed in the lubricant being tested. During this test, the contact force between the top ball and three lower balls, or test load, is raised in stages until the balls weld together at a point known as the weld load. A higher weld load is more desirable and is generally a characteristic of lubricants/greases with better lubrication properties. FIGS. 6A-6C show graphs illustrating the results of experiments in which lubricant grease containing various quantities of ZDDP, FI-PTFE, catalyst, and/or molybdenum disulfide were present. The results shown in FIGS. 6A-6C are predicted values of weld loads based on a design of experiments wherein several chemistries of greases were tested and the data used to predict the outcome for the chemistries listed. The actual data used for the predicted values are listed in FIGS. 7A and 7B.

FIG. 6A is a graph showing the weld load for greases comprising varying amounts of ZDDP, FI-PTFE, and catalyst with 0.5 weight percent molybdenum disulfide. At a 2.0 weight percent concentration for each of ZDDP and FI-PTFE, with minimum (0.2 weight percent) ferric fluoride catalyst present, the weld load for the composition was determined to be approximately 642 kg compared to a base weld load of approximately 197 kg.

The compositions tested to generate the results shown in FIG. 6B comprised varying amounts of ZDDP and FI-PTFE together with 1.25 weight percent molybdenum disulfide. Here, the weld load was determined to be approximately 719 kg at a 2.0 weight percent concentration of ZDDP and FI-PTFE with minimum (0.2 weight percent) ferric fluoride catalyst present. The base weld load of grease with 1.25 weight percent molybdenum disulfide is approximately 258 kg.

The compositions tested to generate the results shown in FIG. 6C comprised varying amounts of ZDDP and FI-PTFE together with 2.0 weight percent molybdenum disulfide. Ferric fluoride catalyst (0.2 weight percent) was present. In other embodiments, ferric fluoride at a concentration of about 0.1 to about 1.0 weight percent may be used. At a 2.0 weight percent concentration of ZDDP and FI-PTFE, respectively, the weld load for the composition was determined to be approximately 796 kg with minimum ferric fluoride catalyst present. The base weld load of grease with 2.0 weight percent molybdenum disulfide is approximately 319 kg.

The results of the experiments shown in the graphs of FIGS. 6A-6C indicate that increasing the concentration of molybdenum disulfide provides an increase in the lubricant properties of the grease formulation, although the increase is quite modest compared to the effect of adding ZDDP and FI-PTFE to the grease. The graphs show that a synergistic interaction between ZDDP and FI-PTFE is present, as ZDDP and FI-PTFE by themselves do not provide significant extreme-pressure protection. Extreme pressure protection by an additive means protecting metal surfaces in boundary lubrication where there are high local temperatures as a result of metal to metal contact under heavy load. Extreme pressure protection helps to prevent the welding of opposing asperities on metal surfaces in contact with each other when those surfaces are under high loads. The addition of 2.0 weight percent ZDDP and 2.0 weight percent FI-PTFE to the grease more than doubled the weld load for the grease composition compared to the grease comprising molybdenum disulfide alone.

Figure 7A:
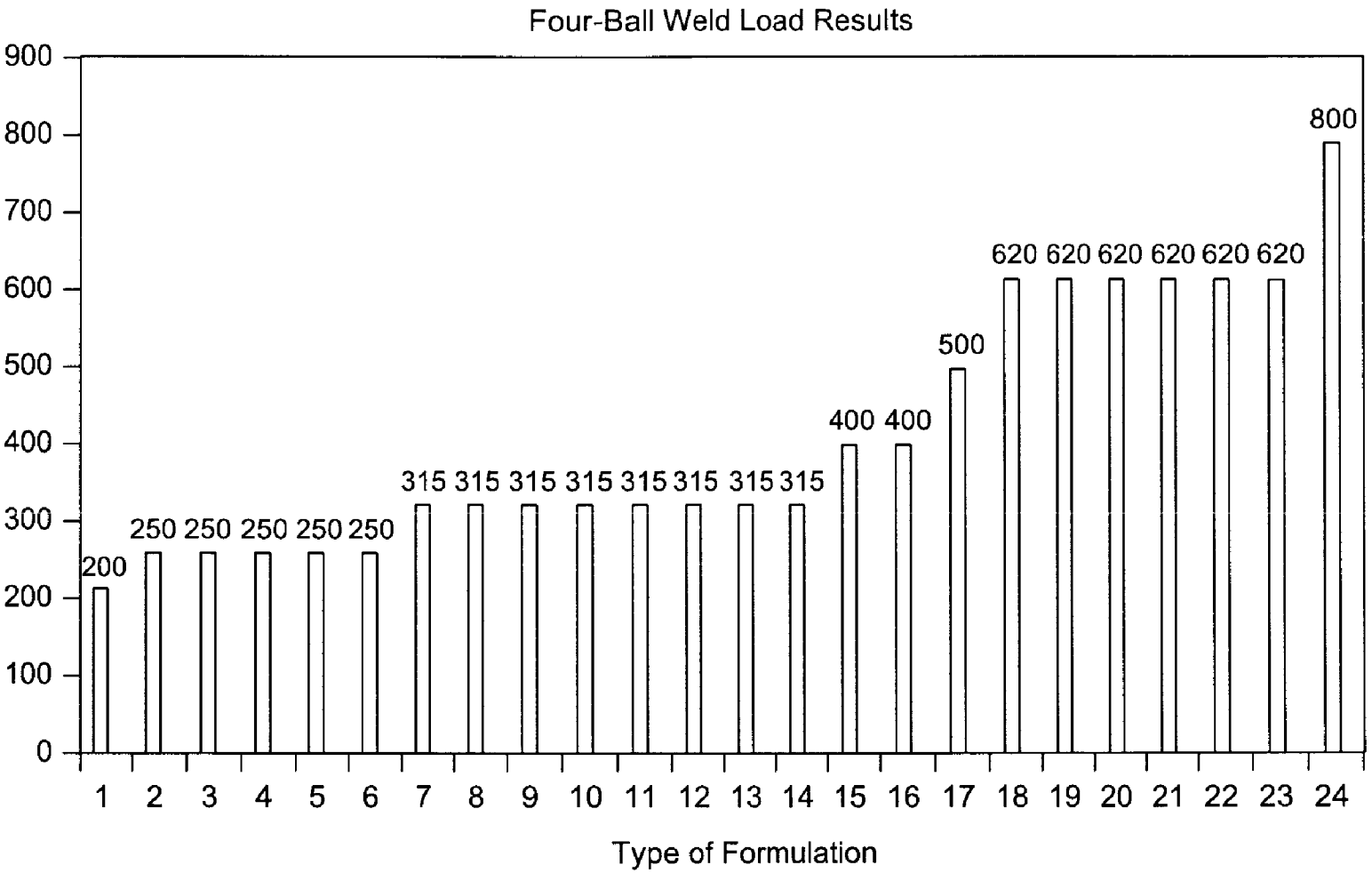

FIG. 7A is a bar chart summarizing the results of the experiments used to generate the cube graphs of FIGS. 6A-6C. The highest weld load obtained (796 kg) was with a grease composition of 2.0 weight percent ZDDP, 2.0 weight percent FI-PTFE, and molybdenum disulfide together with 0.2 weight percent ferric fluoride catalyst. FIG. 7B is a legend corresponding to the horizontal axis labels of FIG. 7A with columns arranged from left to right. The results shows (samples 22 and 23 in FIG. 7B) that a 620 kg weld load can be obtained with as little as 2 percent ZDDP and 2 percent FI-PTFE and no other ingredients, indicating a strong synergism between FI-PTFE and ZDDP (as seen in FIGS. 6A-C).

In a preferred embodiment of the current invention, sufficient ZDDP is added to the base grease to yield a concentration of about 0.01 to 0.5 wt.% phosphorus in the finished grease.

Block on Cylinder Tests (Modified Timken Tests)

Figure 8:
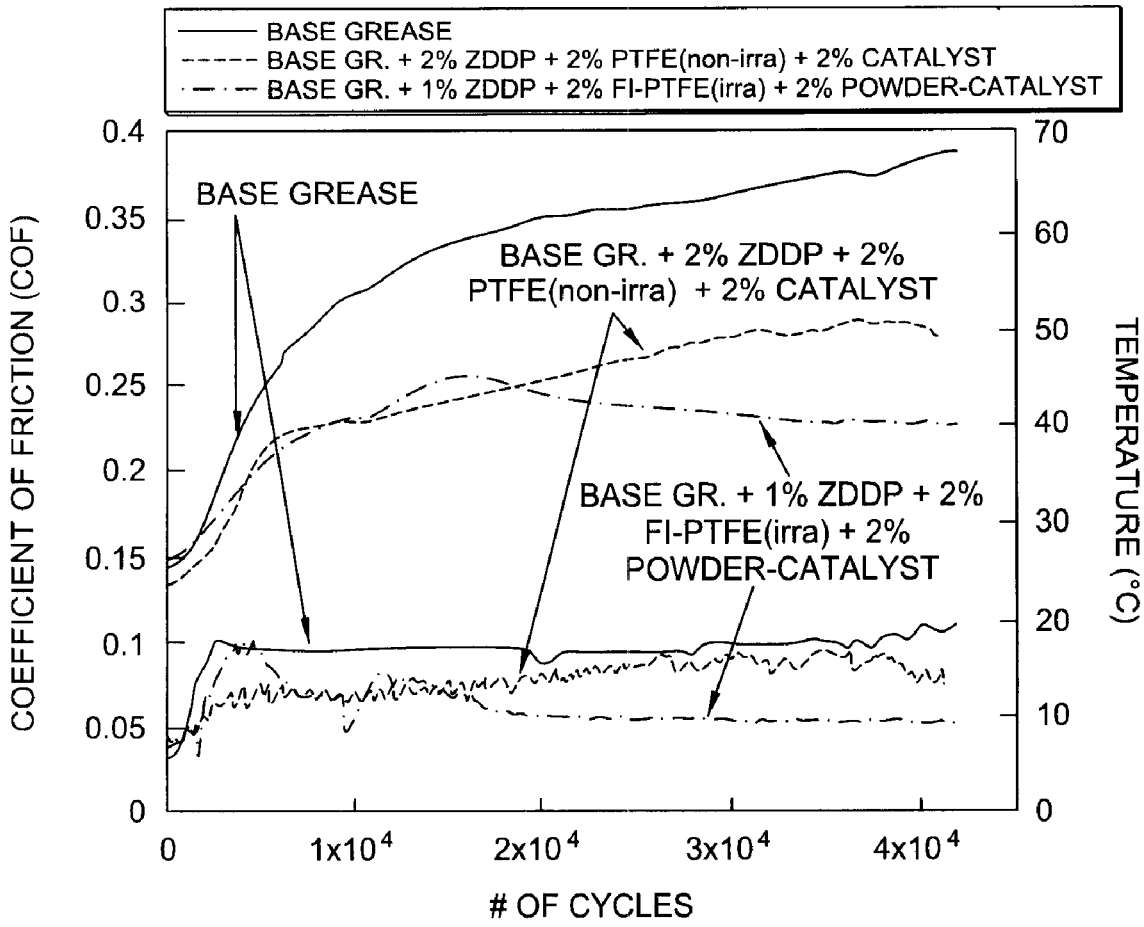
FIG. 8 is a graph summarizing the results of a block on cylinder test for various greases.
Figure 9:
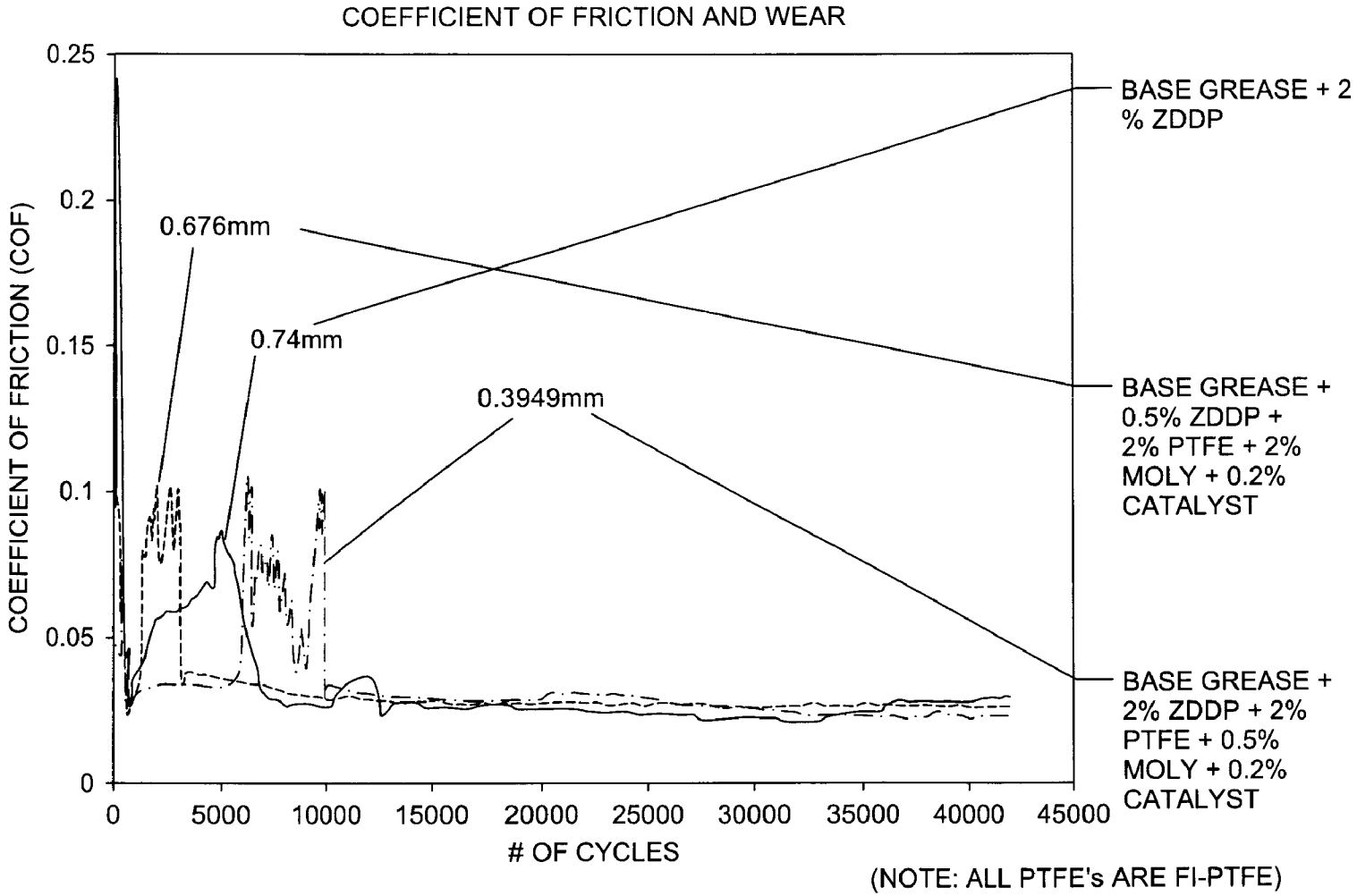
FIG. 9 is a graph of experimental COF and wear results from a block on cylinder test comparing several grease compositions.

FIGS. 8-10 show the results of block on cylinder tests that model the wear life properties of lubricants under the rotating motion of a ring against a block. A cylinder, with 4 grams of the test lubricant applied uniformly on its outer surface, is rotated at 700 rpm against a test block. The test block is raised from underneath the cylinder and contacts the cylinder with a pre-determined load applied by a pneumatic system. The width of the wear scar on the block is used as a measure of wear performance. The COF and test temperature are determined as part of the test. The tests were conducted for a total of one hour at a load of 20 kg for 42,000 cycles.

FIG. 8 shows that lubricant compositions comprising FI-PTFE performed better than non-irradiated PTFE. A base grease composition showed the highest COF (>0.10) and the highest temperature (68° C.)at the completion of the test run. A grease composition comprising 2.0 weight percent ZDDP, 2.0 weight percent non-irradiated PTFE, 2.0 weight percent powdered ferric fluoride catalyst and base grease performed significantly better, with a coefficient of friction of approximately 0.08 and a test temperature of about 50° C. at the end of the test. The test grease composition comprising 1.0 weight percent ZDDP, 2.0 weight percent FI-PTFE, 2.0 weight percent powdered ferric fluoride catalyst and base grease performed the best, with a coefficient of friction of approximately 0.05 and a test temperature of about 40° C. at test completion. In the absence of additives, the contact temperature increases continuously and no protective film is formed on the surface. The graph of the composition comprising FI-PTFE evidences the formation of a protective tribofilm on the surface and a corresponding drop in temperature of the test block. Optical micrographs (not shown) indicate that the grease composition with FI-PTFE produces the narrowest and shallowest wear scar of the three tested compositions. The results summarized in FIG. 8 indicate that compositions comprising FI-PTFE perform better than compositions comprising non-irradiated PTFE, even with lower ZDDP content.

FIG. 9 is a graph of experimental results from a block on cylinder test comparing several grease compositions. The graph shows the calculated COF and wear scars for several experimental compounds. A grease composition comprising 2.0 weight percent ZDDP and base grease produced a wear scar width of 0.74 mm. A grease composition comprising 0.5 weight percent ZDDP, 2.0 weight percent FI-PTFE, 2.0 weight percent molybdenum disulfide, and 0.2 weight percent ferric fluoride catalyst and base grease produced a wear scar width of 0.676 mm. The best result was obtained with a grease composition comprising 2.0 weight percent ZDDP, 2.0 weight percent FI-PTFE, 0.5 weight percent molybdenum disulfide, and 0.2 weight percent ferric fluoride catalyst and base grease, which produced a wear scar of 0.3949 mm. This data set indicates a synergistic interaction between ZDDP, FI-PTFE and ferric fluoride yields low coefficients of friction and the best wear results. All these produce similar COFs of less than 0.03.

FIG. 10 shows 3-dimensional predictions of wear scar dimensions based on experimental results from block on cylinder tests comparing grease compositions. The loads used were 15-30 kg in these tests. The wear scar from a grease composition comprising 0.5 weight percent ZDDP was determined to be 0.456 mm, while the same grease composition comprising ZDDP increased to 2.0 weight percent produced a much smaller wear scar of 0.365 mm. This beneficial behavior of ZDDP is maintained at various molybdenum disulfide concentrations. For both compositions, increasing concentrations of molybdenum disulfide also increased the wear scar width. For example, at a 2.0 weight percent concentration of ZDDP, the wear scar width was 1.319 mm when the composition comprised 2.0 weight percent molybdenum disulfide, and only 0.365 mm with 0.5 weight percent molybdenum disulfide. The results indicate that molybdenum disulfide is antagonistic to wear performance at low loads, resulting in an increase in wear.

Figure 11:
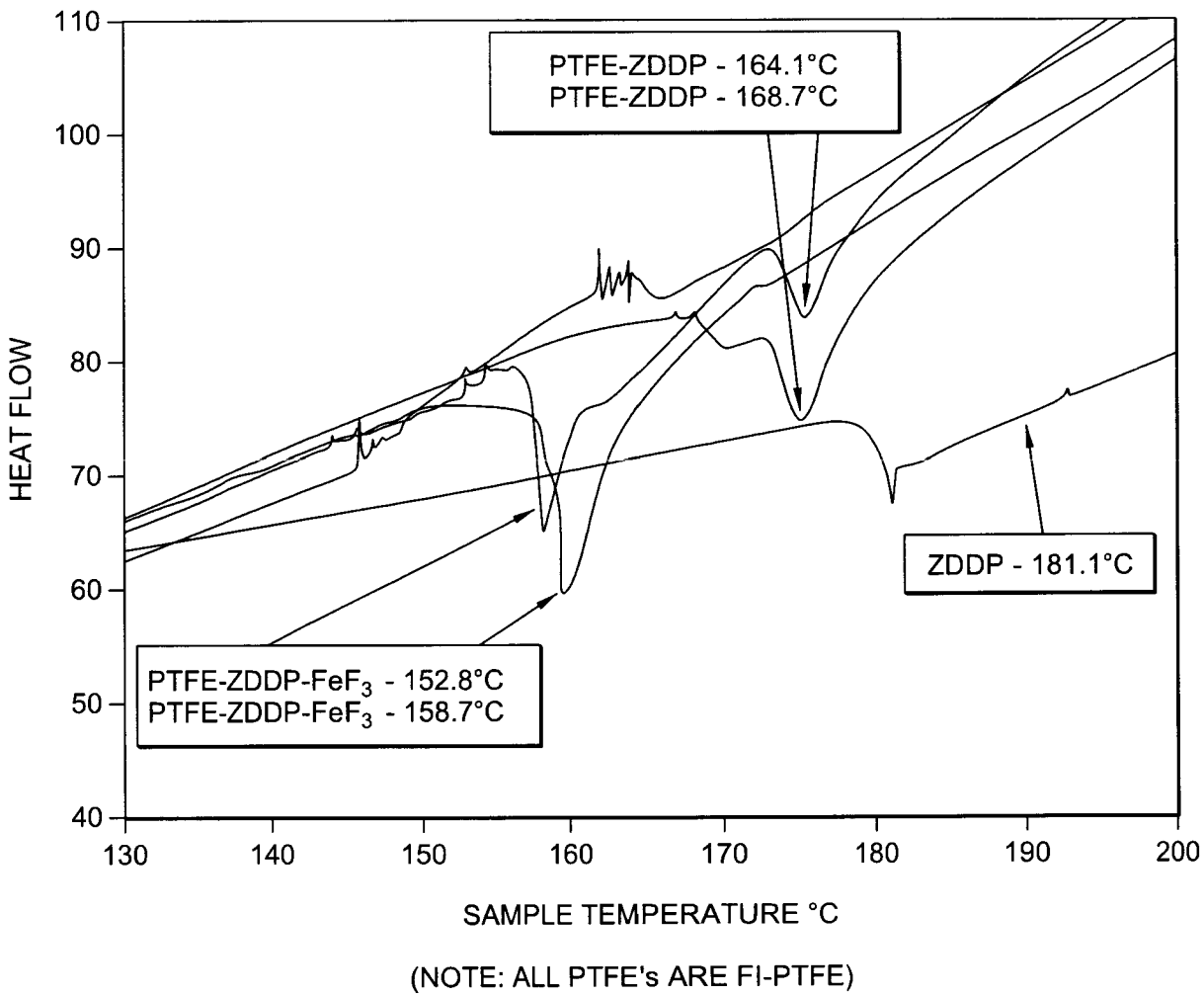
FIG. 11 shows the results of differential scanning calorimetry (DSC) tests to determine the decomposition temperatures of ZDDP.

FIG. 11 shows the results of DSC tests to determine the decomposition temperatures of ZDDP. The DSC tests were performed at −30° C. to 250° C. at a ramp rate of 1° C./minute under nitrogen. The samples were heated in hermetically-sealed aluminum pans. ZDDP alone decomposes at approximately 181° C. In the presence of FI-PTFE (irradiated, Nanoflon™ powder), ZDDP decomposes at approximately 166° C., and decomposes at 155° C. in the presence of FI-PTFE and ferric fluoride catalyst. ZDDP and FI-PTFE were mixed in a 1:1 ratio, and ZDDP/FI-PTFE/ferric fluoride were mixed in a 2:2:1 ratio. The DSC results indicate that in the presence of FI-PTFE the decomposition temperature of ZDDP is reduced by approximately 15° C. In the presence of both FI-PTFE and ferric fluoride, the decomposition temperature is reduced by approximately 26° C.

4-Ball Wear and Weld Test

Figure 12:
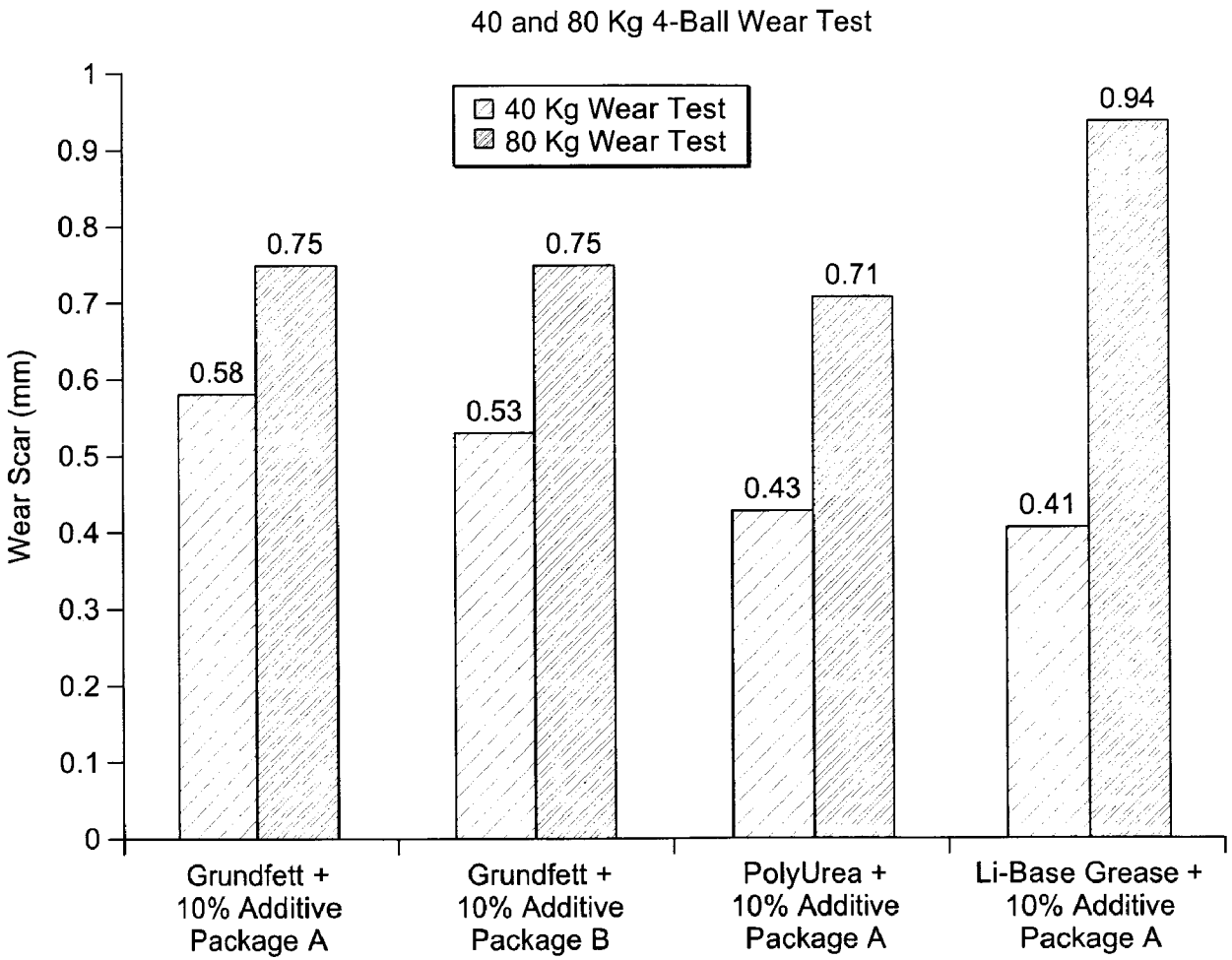
FIG. 12 is a chart summarizing the results of ASTM D2266 4-Ball Wear experiments in which various lubricant greases containing different quantities of FI-PTFE and ZDDP were tested.

FIG. 12 shows 4-ball wear tests conducted at loads of 40 and 80 kg on greases that contain the additive package that contains organophosphates, organofluorides and/or moly disulfide. The tests were conducted at 75° C. for a duration of 1 hour at 1800 RPM. The wear scars were measured at the end of the test. The wear tests indicate that with 10% of the additive package, wear scars as small as 0.41 mm are possible at loads of 40 kg. At loads of 80 kg, wear scars as small as 0.71 mm are possible with 10% of the additive package. In both cases small numbers are better.

Figure 13:
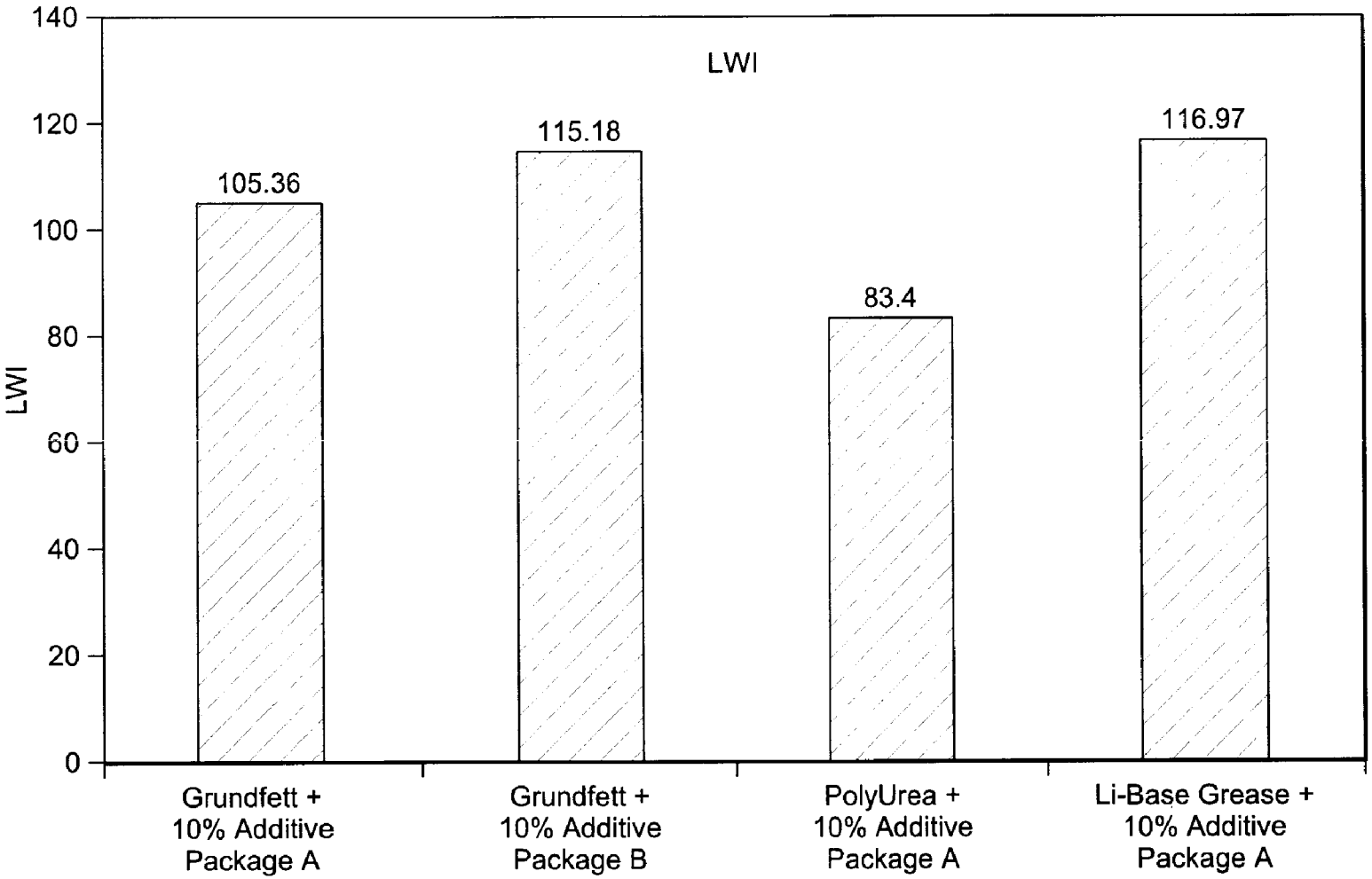
FIG. 13 is a chart summarizing the results of ASTM D2596 4-Ball Load Wear Index experiments in which various lubricant greases containing different quantities of FI-PTFE and ZDDP were tested.

FIG. 13 shows the load wear index (ASTM D2783) of the greases with 10% of the additive package that contains organophosphates, organofluorides and/or moly disulfide. Load wear index numbers as high as 117 were achieved. Large numbers in the load wear index are desirable.

Figure 14:
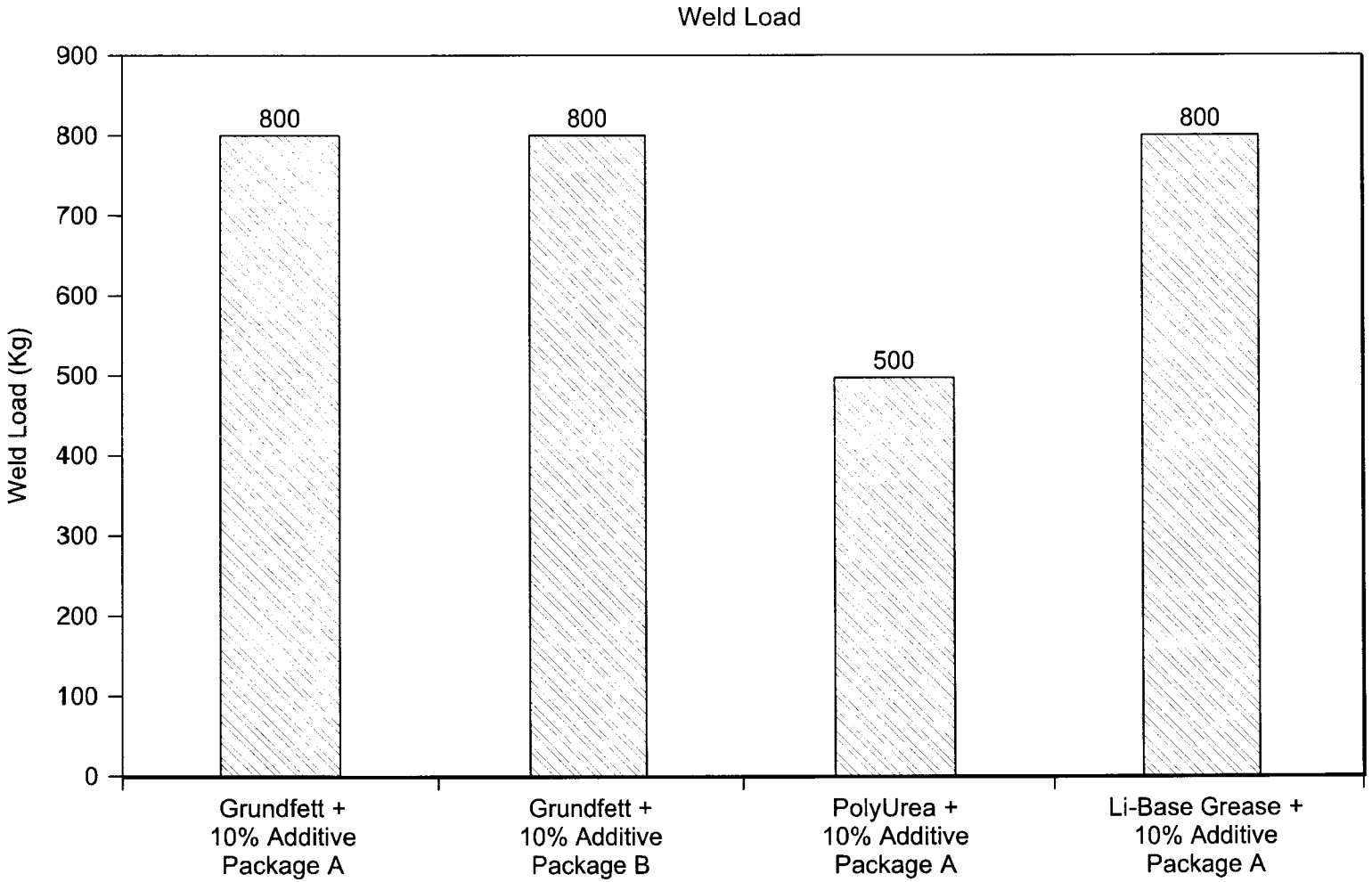
FIG. 14 is a chart summarizing the results of ASTM D2596 4-Ball Weld experiments in which various lubricant greases containing different quantities of FI-PTFE and ZDDP were tested.

FIG. 14 shows 4-ball weld load (ASTM D2596) with 10% additive package. Weld loads as high as 800 kg were achieved. Large numbers are desirable.

Figure 15:
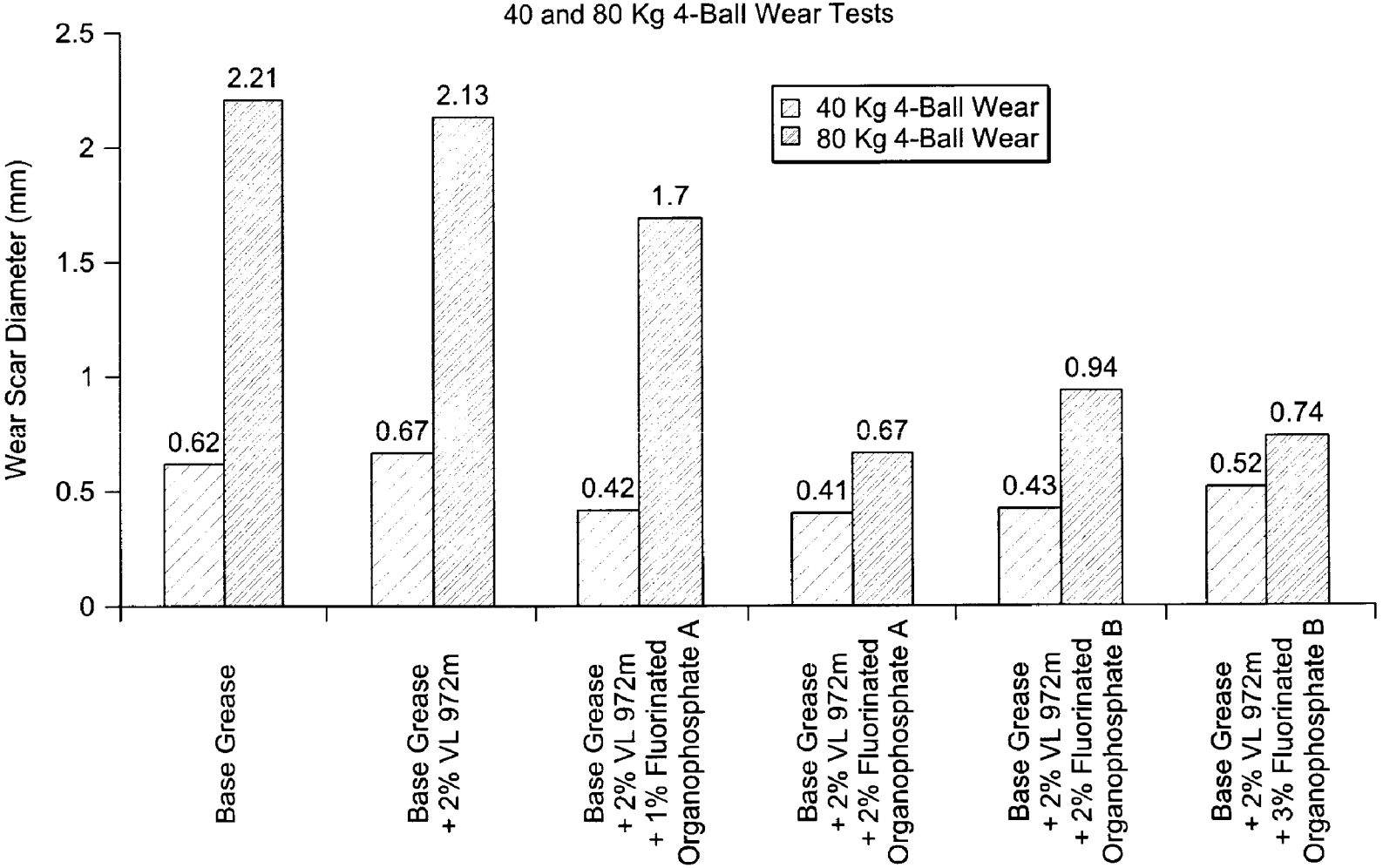
FIG. 15 is a chart summarizing the results of ASTM D2266 4-Ball Wear experiments in which lubricant grease containing various different quantities of sulphurized additives and fluorinated ZDDP were tested.

FIG. 15 shows 4-ball wear (ASTM D2596) tests of greases with various additive packages, including Vanlube 972M, a thiodiazole. The addition of fluorinated organophosphates result in significant reduction in the 4-ball wear outcomes at both 40 and 80 kg. Small numbers are better.

Ball on Cylinder Test

Figure 16:
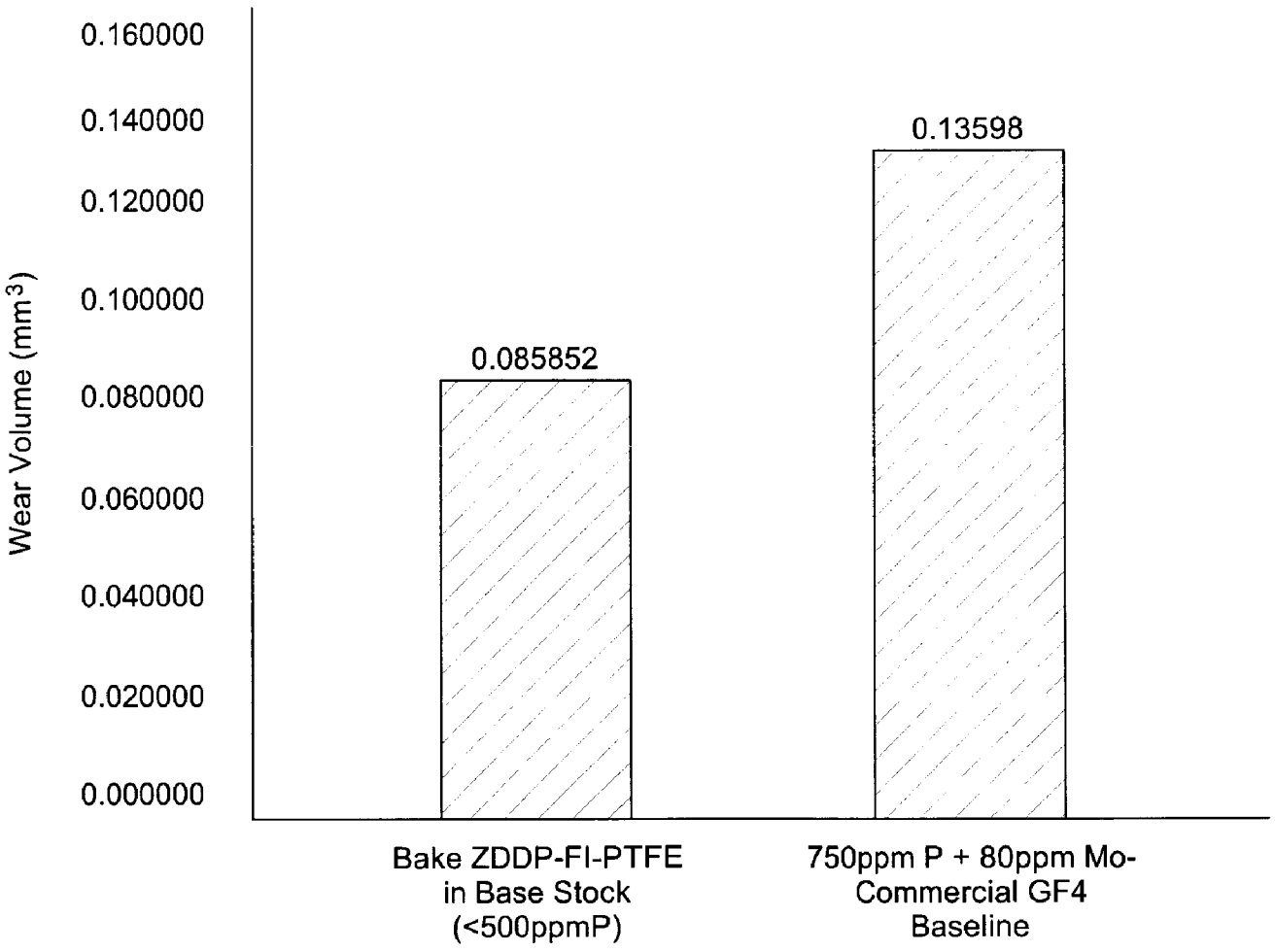
FIG. 16 shows wear volume test results for engine oils from a ball on cylinder test.

FIG. 16 shows wear volume test results for engine oils. The test used is a ball on cylinder test that evaluates the wear-preventing properties of lubricants. A steel cylinder (67 HRC) is rotated at 700 rpm against a tungsten carbide (78 HRC) ball which is loaded with a lever arm to apply a 30 kg load. 50 μL of the test lubricant is uniformly applied through the outer surface of the cylinder at the point of contact with the ball. Wear track depth and wear volume are calculated at the conclusion of the test. The lubricant compositions were prepared as follows. ZDDP and FI-PTFE in a 1:1 ratio were baked in air at 150° C. for 20 minutes and then centrifuged to remove all solids. A measured quantity of the supernatant liquid was added to Chevron 100N base oil to yield less than 500 ppm phosphorous for the lubricant composition. The graph shows that the wear volume for this composition was 0.0859 $mm^3$ compared to the wear volume of 0.136 $mm^3$ for a fully formulated commercial ILSAC GF4 oil comprising 750 ppm phosphorous and 80 ppm soluble molybdenum compound. The results indicate that the synergistic effects of a ZDDP/FI-PTFE composition are effective in formulations intended for engine usage. In a preferred embodiment of the current invention, sufficient ZDDP/FI-PTFE is added to yield 0.01 to 0.1 wt.% of phosphorus in the finished engine oil.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for producing a lubricant comprising:

forming a reaction mixture by reacting an organophosphate, a metal halide, and an organofluorine selected from the group consisting of:

FI-PTFEs comprised of molecules with more than 40 carbon atoms, fluoroalkyl carboxylic acids, fluoroaryl carboxylic acids, fluoroalkylaryl carboxylic acids, fluoroalkyl sulfonic acids, fluoroaryl sulfonic acids and fluoroalkylaryl sulfonic acids; and adding at least a portion of the reaction mixture to a lubricant base so as to give said lubricant extreme pressure and anti-wear properties.

2. The method of claim 1 wherein said organophosphate is ZDDP and said organofluorine is said FI-PTFE comprising greater than 40 carbon atoms.

3. The method of claim 2 wherein the ZDDP is selected from the group consisting of:

neutral ZDDP (primary), neutral ZDDP (secondary), basic ZDDP (primary), basic ZDDP (secondary), ZDDP salt, and combinations thereof

4. The method of claim 1 wherein the FI-PTFE, fluoroalkyl carboxylic acids, fluoroaryl carboxylic acids, fluoroalkylaryl carboxylic acids, fluoroalkyl sulfonic acids, fluoroaryl sulfonic acids and fluoroalkylaryl sulfonic acids have at least one functional group consisting of:

carboxylic acids, sulfonic acids, esters, alcohols, amines, amides, or mixtures thereof

5. The method of claim 1 wherein said reaction mixture comprises a supernatant, the method further comprising:

separating said supernatant from said formed reaction mixture and adding at least a portion of said supernatant to said lubricant base.

6. The method of claim 1 wherein said reaction mixture comprises a precipitate, the method further comprising:

separating said precipitate from said formed reaction mixture and adding at least a portion of said precipitate to said lubricant base.

7. The method of claim 1 wherein the lubricant further comprises forming a reaction mixture by reacting molybdenum disulfide with the metal halide, organophosphate, and organofluorine.

8. The method of claim 1 wherein the metal halide is selected from the group consisting of:

aluminum trifluoride, zirconium tetrafluoride, titanium trifluoride, titanium tetrafluoride, ferric fluoride, chromium difluoride, chromium trifluoride, nickel difluoride, stannous difluoride, stannous tetrafluoride, and combinations thereof.

9. The method of claim 1 wherein said lubricant comprises from about 0.01 weight percent phosphorous to about 0.5 weight percent phosphorous.

10. The method of claim 1 wherein the reaction mixture is formed by reacting the organophosphate, the metal halide, and the organofluorine together for about 20 minutes to about 24 hours.

11. The method of claim 1 wherein the reaction mixture is formed by reacting the organophosphate, the metal halide, and the organofluorine together at a temperature of about 40° C. to about 125° C.

12. A method for producing a lubricant comprising:

forming a reaction mixture by reacting molybdenum disulfide with an organophosphate and an organofluorine selected from the group consisting of:

FI-PTFEs comprised of molecules with more than 40 carbon atoms, fluoroalkyl carboxylic acids, fluoroaryl carboxylic acids, fluoroalkylaryl carboxylic acids, fluoroalkyl sulfonic acids, fluoroaryl sulfonic acids and fluoroalkylaryl sulfonic acids; and adding at least a portion of the reaction mixture to a lubricant base so as to give said lubricant extreme pressure and anti-wear properties.

13. A method of producing a lubricant, said method comprising:

adding an organophosphate, a metal halide, and an organofluorine selected from the group consisting of FI-PTFE, fluoroalkyl carboxylic acids, fluoroaryl carboxylic acids, fluoroalkylaryl carboxylic acids, fluoroalkyl sulfonic acids, fluoroaryl sulfonic acids, or fluoroalkylaryl sulfonic acids to a lubricant base; and reacting said organophosphate, said metal halide, and said organofluorine in said lubricant base so as to form a lubricant with extreme pressure and anti-wear properties.

14. The method of claim 13 wherein said organophosphate is ZDDP and said organofluorine is FI-PTFE comprised of more than 40 carbon atoms.

15. The method of claim 14 wherein the ZDDP is selected from the group consisting of:

neutral ZDDP (primary), neutral ZDDP (secondary), basic ZDDP (primary), basic ZDDP (secondary), ZDDP salt, and combinations thereof.

16. The method of claim 13 wherein the FI-PTFE, fluoroalkyl carboxylic acids, fluoroaryl carboxylic acids, fluoroalkylaryl carboxylic acids, fluoroalkyl sulfonic acids, fluoroaryl sulfonic acids and fluoroalkylaryl sulfonic acids have at least one functional group consisting of:

carboxylic acids, sulfonic acids, esters, alcohols, amines, amides, or mixtures thereof.

17. The method of claim 13 wherein said lubricant comprises from about 0.01 weight percent phosphorous to about 0.5 weight percent phosphorous.

18. The method of claim 13 wherein:

adding further comprises adding molybdenum disulfide, said metal halide, said organophosphate, and said organofluorine to a lubricant base; and reacting further comprises reacting said molybdenum disulfide, said metal halide, said organophosphate, and said organofluorine to form a lubricant.

19. The method of claim 13 wherein said metal halide is selected from the group consisting of:

aluminum trifluoride, zirconium tetrafluoride, titanium trifluoride, titanium tetrafluoride, ferric fluoride, chromium difluoride, chromium trifluoride, nickel difluoride, stannous difluoride, stannous tetrafluoride, and combinations thereof.

20. The method of claim 13 wherein said reacting comprises reacting from about 20 minutes to about 24 hours.

21. The method of claim 13 wherein said reacting comprises reacting at a temperature of about 40° C. to about 125° C.

22. A method for producing a grease comprising:

forming a reaction mixture by reacting an organophosphate, a metal halide, and an organofluorine selected from the group consisting of:

FI-PTFEs comprised of more than 40 carbon atoms, fluoroalkyl carboxylic acids, fluoroaryl carboxylic acids, fluoroalkylaryl carboxylic acids, fluoroalkyl sulfonic acids, fluoroaryl sulfonic acids and fluoroalkylaryl sulfonic acids; and adding at least a portion of the reaction mixture to a grease base so as to give said grease extreme pressure and anti-wear properties.

23. The method of claim 22 wherein said organophosphate is ZDDP and said organofluorine is said FI-PTFE comprised of more than 40 carbon atoms.

24. The method of claim 22 wherein said forming further comprises forming a reaction mixture by reacting molybdenum disulfide with the metal halide, organophosphate, and organofluorine.

25. A method for producing a lubricant comprising:

reacting molybdenum disulfide with an organophosphate and an organofluorine selected from the group consisting of:

FI-PTFEs comprised of more than 40 carbon atoms, fluoroalkyl carboxylic acids, fluoroaryl carboxylic acids, fluoroalkylaryl carboxylic acids, fluoroalkyl sulfonic acids, fluoroaryl sulfonic acids and fluoroalkylaryl sulfonic acids; wherein said reaction does not occur in a lubricant base and at least a portion of products of said reaction is added to a lubricant base or said reaction takes place in said lubricant base.

* * * * *